US007769311B2

(12) United States Patent
Tsubaki

(10) Patent No.: US 7,769,311 B2
(45) Date of Patent: Aug. 3, 2010

(54) IMAGE FORMING APPARATUS CONTROLLING AN ATTACHMENT AMOUNT OF TONER AND A PREHEATING CONDITION AND IMAGE FORMING METHOD

(75) Inventor: Yoritaka Tsubaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 106 days.

(21) Appl. No.: 12/125,473

(22) Filed: May 22, 2008

(65) Prior Publication Data

US 2008/0292346 A1 Nov. 27, 2008

(30) Foreign Application Priority Data

May 22, 2007 (JP) ..... 2007-135932
Apr. 10, 2008 (JP) ..... 2008-102957

(51) Int. Cl.
*G03G 15/20* (2006.01)

(52) U.S. Cl. ..... 399/67; 399/329; 430/108.1; 430/110.4; 430/124.3

(58) Field of Classification Search ..... 399/329, 399/328, 320, 45, 67, 69; 219/216; 347/156; 430/124.1, 124.3, 108.1, 108.8, 110.3, 110.4
See application file for complete search history.

(56) References Cited

U.S. PATENT DOCUMENTS

2004/0081907 A1* 4/2004 Akazawa et al. ..... 430/111.4
2005/0129430 A1* 6/2005 Kim ..... 399/328
2006/0051115 A1* 3/2006 Kamiya ..... 399/53
2006/0198671 A1* 9/2006 Kawahata ..... 399/329
2007/0003858 A1* 1/2007 Akazawa et al. ..... 430/108.1 X
2007/0059059 A1* 3/2007 Fujino ..... 399/329
2007/0231729 A1* 10/2007 Ohno et al. ..... 430/108.24
2008/0014521 A1* 1/2008 Tsubaki et al. ..... 430/108.1
2008/0090165 A1* 4/2008 Yamada et al. ..... 430/109.4
2008/0267674 A1* 10/2008 Shimizu et al. ..... 399/307
2009/0067898 A1* 3/2009 Tseng et al. ..... 399/328

FOREIGN PATENT DOCUMENTS

JP 63-100759 U 6/1988
JP 9-160408 A 6/1997
JP 2003-271007 A 9/2003
JP 2003-280421 A 10/2003
JP 2006-154244 A 6/2006

* cited by examiner

*Primary Examiner*—Sophia S Chen
(74) *Attorney, Agent, or Firm*—Nixon & Vanderhye P.C.

(57) ABSTRACT

An image forming apparatus and an image forming method are provided which form high-quality fixed images having no fogs and the like defects, in which apparatus and method a toner entering a pressure-contact area between rollers is prevented from scattering. A control is performed on preheating conditions for preheating an unfixed toner image on a recording medium, which unfixed toner image indicates a toner image transferred but not yet fixed, and a control is further performed such that an amount of toner attached to the recording medium at a coverage rate of 100% is 0.4 mg/cm$^2$ or less, with the result that the toner is prevented from scattering when the recording medium carrying the unfixed toner image passes through a pressure-contact area formed between a heating roller and a pressurizing roller in a fixing step.

10 Claims, 4 Drawing Sheets

IMAGE FORMING APPARATUS CONTROLLING AN ATTACHMENT AMOUNT OF TONER AND A PREHEATING CONDITION AND IMAGE FORMING METHOD

CROSS-REFERENCE TO RELATED APPLICATION

This application claims priority to Japanese Patent Application No. 2007-135932, which was filed on May 22, 2007, and Japanese Patent Application No. 2008-102957, which was filed on Apr. 10, 2008, the contents of which are incorporated herein by reference in its entirety.

BACKGROUND OF THE INVENTION

1. Field of the Invention

The present invention relates to an image forming apparatus and an image forming method.

2. Description of the Related Art

An image forming apparatus using an electrophotographic method forms an image by developing a latent image formed on a photoreceptor to form a toner image and then, transferring and fixing the toner image onto a recording medium such as paper. As a fixing method, a heat-pressure fixing method is generally used.

The heat-pressure fixing method is a method of pressing and heating the recording medium onto which a toner image has been transferred and not yet fixed, through a pressure-contact area between a pair of rollers which rotate in pressure-contact with each other and at least one of which is heated. Upon making the pressing and heating, a main component of toner composition, i.e., thermoplastic resin is fused and softened so as to be adhered to the recording medium, thus being fixed as a toner image onto the recording medium.

Properties desired for an image forming apparatus include higher speed and availability for various kinds of recording mediums. In the heat-pressure fixing method, however, fixing speed is limited based on heat quantity available for a recording medium and therefore, the number of sheets having images formed thereon is also limited per unit of time during a continuous image forming operation. And what is worse, in a fixing process for recording medium such as heavy paper, the heat quantity to be supplied to the recording medium must be set to be larger, or alternatively, fixing speed must be set to be lower, compared to those in a fixing process for a recording medium such as plain paper.

In view of the above matters, suggestions have been made to preheat recording mediums having toner images transferred thereto, up to a predetermined temperature (in an approximate range of 100° C. to a toner softening temperature) before the recording mediums are subjected to a fixing process so that differences among fixing conditions depending on recording medium-related information including a type, size, or the like element of the recording mediums are canceled out each other, thereby preventing image quality from being degraded.

In the case just stated, another problem arose such that when the toner image is heated on the recording medium to be fixed thereto by pressure, a larger amount of toner attached onto the recording medium causes the toner to scatter even to edges and then be fixed thereto, resulting in rough edges and rough image boundaries, which result represents degraded image quality.

The problem as above became more prominent as a toner had smaller particles and was more spherical along with an increasing demand for higher-quality images and higher-resolution images.

In a technique disclosed by Japanese Unexamined Patent Publication JP-A 9-160408 (1997), a temperature of a thermal heater in a preheating section is switched to a predetermined temperature depending on a material of recording medium inputted to a control unit, and information of detected temperature of a belt member is allowed to be accurately fed back to the control unit owing to a temperature sensor installed in the thermal heater, thus achieving such a configuration that toner images transferred onto recording mediums different in material and thickness are all heated to a certain preliminary temperature, with the result that high-quality images can be recorded on various transfer materials.

In a technique disclosed by Japanese Unexamined Patent Publication JP-A 2003-271007, a fixing device of heat-pressure fixing method is provided with a preheating section for preheating a recording medium having a toner image not yet fixed thereto so that a temperature of the recording medium entering a pressure-contact area between rollers falls in a predetermined temperature range, whereby a proper amount of heat is applied to the recording medium in the fixing process, not depending on a type, size, or the like element of the recording medium, thus being capable of forming a fixed image of high quality.

In a technique disclosed by Japanese Unexamined Patent Publication JP-A 2006-154244, a fixing device having a preheating section for preheating a recording medium before a fixing process, uses a polymerized toner having a two-layered core-shell structure of which shell part is made of resin that is softened when preheated, thereby causing a toner-to-toner attachment which eliminates scattering and hovering of the toner whereby no such phenomena occur as toner scattering and toner tailing in the fixing process, with the result that a high-quality and high-resolution image can be formed.

In the technique disclosed by JP-A 9-160408, the preliminary temperature is maintained in the range of 100° C. or more and a toner softening temperature or less, and the toner on the recording medium is preheated to a temperature around its softening temperature. It is therefore inferred that toner-to-toner fusion may partly occur, but in the case where the amount of toner attached to the recording medium is large, the toner cannot be completely prevented from scattering.

In the technique disclosed by JP-A 2003-271007, the preliminary temperature is low, about 100° C. or less, so that the preheating process does not cause toner fusion. The toner therefore scatters, thus degrading image quality, especially in the case where the amount of toner attached to the recording medium is large.

In the technique disclosed by JP-A 2006-154244, an amount of toner attached to the recording medium is not considered and therefore, in the case where the amount of toner attached to the recording medium is large, heat is transferred to not an entire toner layer during the preheating process, resulting in insufficient toner-to-toner fusion which deteriorates image quality when the toner is prevented from scattering. In addition, since the technique disclosed by JP-A 2006-154244 relates to the polymerized toner which is substantially spherical, such a shape causes the toner particles to easily come off from a toner layer before the preheating step, thus causing the toner to scatter.

SUMMARY OF THE INVENTION

An object of the invention is to provide an image forming apparatus and image forming method capable of forming high-quality fixed images having no fogs and the like defects, in which apparatus and method the existing problems stated above have been solved and a toner entering a pressure-contact area between rollers is prevented from scattering.

The invention provides an image forming apparatus comprising:

a toner image forming section including an image forming member, which forms a toner image on a surface of the image forming member;

an attachment amount controlling section which controls the toner image forming section so that an amount of toner attached to a recording medium at a coverage rate of 100% is 0.4 mg/cm$^2$ or less;

a transferring section which transfers the toner image to the recording medium;

a preheating section which preheats the unfixed toner image transferred to the recording medium before the unfixed toner image is fixed to the recording medium;

a preheating condition controlling section which controls a preheating condition in the preheating section; and a fixing section which fixes the unfixed toner image to the recording medium by letting the unfixed toner image preheated pass through a pressure-contact area formed between a heating roller and a pressurizing roller.

According to the invention, the image forming apparatus includes a toner image forming section, an attachment amount controlling section, a transferring section, a preheating section, a preheating condition controlling section, and a fixing section. The toner image forming section includes an image forming member and forms a toner image on a surface of the image forming member. The attachment amount controlling section controls the toner image forming section so that an amount of toner attached to the recording medium at a coverage rate of 100% is 0.4 mg/cm$^2$ or less. The transferring section transfers the toner image to the recording medium. The preheating section preheats an unfixed toner image transferred to the recording medium before the unfixed toner image is fixed to the recording medium. The preheating condition controlling section controls a preheating condition in the preheating section. The fixing section fixes the unfixed toner image to the recording medium by letting the unfixed toner image preheated pass through a pressure-contact area formed between a heating roller and a pressurizing roller.

The preheating condition controlling section controls the preheating conditions so that the preheating section preheats the unfixed toner on the recording medium, which unfixed toner indicates a toner transferred but not yet fixed, and further, the attachment amount controlling section performs such a control that the amount of toner attached to the recording medium at a coverage rate of 100% is 0.4 mg/cm$^2$ or less, with the result that the toner is prevented from scattering when the recording medium carrying the unfixed toner passes through a pressure-contact area formed between the heating roller and the pressurizing roller in a fixing step. In the case where the amount of toner attached to the recording medium at a coverage rate of 100% exceeds 0.4 mg/cm$^2$ or less, a temperature of the unfixed toner image transferred to the recording medium does not rise sufficiently in the preheating process, therefore not causing toner-to-toner fusion, and toner scattering and the like trouble will be caused in the fixing step when the recording medium passes through the pressure-contact area formed between the heating roller and the pressurizing roller, resulting in degraded image quality. Moreover, in this case, the scattering toner will be attached to the heating roller and the pressurizing roller, which contamination of the rollers will lead to more obvious degradation of image quality.

Further, in the invention, it is preferable that the toner has a volume average particle size of 3 μm or more and 8 μm or less with a shape factor SF2 of 140 or more and less than 145.

According to the invention, the toner having a volume average particle size of 3 μm or more and 8 μm or less with a shape factor SF2 of 140 or more and less than 145 can be stably supplied to the photoreceptors and further prevented from scattering and moreover, in the preheating process, sufficient toner-to-toner fusion can be attained, thus being capable of stably forming high resolution images without the toner scattered.

In the case where a toner having a volume average particle size of less than 3 μm is used, the toner may be too much charged and less flowable because of its too small particle. When the toner is too much charged and less flowable, the toner is not allowed to be stably supplied to the photoreceptors, which situation may cause a background fog, a decrease in image density, and the like trouble. In the case where a toner having a volume average particle size of more than 8 μm is used, a high-resolution image cannot be formed because of its large particle size. In addition, a toner having a larger particle size has a smaller specific surface area and therefore is less charged per unit volume of the toner. The toner less charged per unit volume thereof cannot be stably fed to the photoreceptors and may scatter in the apparatus, thus causing contamination. Moreover, such a toner has a larger number of air gaps and undesirably leads to an increase in the amount of the toner attached to a recording medium at a coverage rate of 100%, resulting in more obvious degradation of image quality due to the toner scattering when the toner enters the pressure-contact area between the heating roller and the pressurizing roller.

A toner having a shape factor SF2 of less than 140 has toner particles easily falling from a toner layer before the preheating step, and may cause toner scattering. A toner having a shape factor SF2 of 145 or more has larger air gaps among toner particles in a toner layer and during the preheating step, a temperature of the toner transferred but not yet fixed onto the recording medium does not rise sufficiently, thus failing to attain sufficient toner-to-toner fusion.

Further, in the invention, it is preferable that the toner contains a plurality of toner particles, and a spheronization process is applied to at least a part of the toner particles.

According to the invention, the toner contains a plurality of toner particles, and a spheronization process is applied to at least a part of the toner particles. This makes it possible to effectively manufacture the toner having a volume average particle size of 3 μm or more and 8 μm or less with a shape factor SF2 of 140 or more and less than 145.

Further, in the invention, it is preferable that the toner has an average degree of circularity of 0.950 or more and 0.985 or less.

According to the invention, a toner having an average degree of circularity of less than 0.950 has a larger number of air gaps, and a larger amount of the toner is attached to the recording medium at a coverage rate of 100%, resulting in more obvious degradation of image quality due to the toner scattering when the toner enters the pressures-contact area between the heating roller and the pressurizing roller. Furthermore, such a toner lowers the transferring property. A toner having an average degree of circularity exceeding 0.985 will degrade the cleaning property which is thus incompatible with the transferring property.

Further, in the invention, it is preferable that the toner contains a release agent having a melting temperature of 80° C. or less.

According to the invention, in the case of using the toner which contains a release agent having a melting temperature of 80° C. or less, only small heat quantity is required for the preheating process, and the toner-to-toner fusion is more easily attained, with the result that the toner can be furthermore prevented from scattering when entering the pressure-contact area formed between the heating roller and the pressurizing roller so that high-resolution images can be more stably formed without the toner scattered.

Further, in the invention, it is preferable that the preheating condition is controlled in accordance with at least one of usage environment-related information and recording medium-related information.

According to the invention, the preheating condition controlling section controls the preheating condition depending on the usage environment or coverage rate, and kind and size of a recording medium, etc., thereby allowing for the heating operation on the right condition for the recording medium, so that favorable images can be obtained.

Further, in the invention, it is preferable that the recording medium is carried on and conveyed by a preheating belt being on the pressurizing roller, and the recording medium is preheated via the preheating belt by a preheating roller.

According to the invention, the preheating belt is on the pressurizing roller in the fixing section to thereby serve as not only the preheating section but also a conveying section for conveying a recording medium carrying an image transferred thereto, causing an effect that a difference between a conveying speed and a fixing speed is eliminated. In addition, since the preheating belt is in contact with the heating roller in the fixing section, the preheating belt has a temperature maintained at a certain degree so that heat quantity for preheating can be small.

Further, in the invention, it is preferable that the preheating belt is preheated in contact with the preheating roller.

According to the invention, the preheating belt can be easily cooled down and accordingly, for example, in the case of printing on a thinner recording medium immediately after printing on a thicker recording medium, a temperature of the preheating belt can be easily lowered, thus allowing for continuous printing on different temperature conditions. Since the preheating roller and the preheating belt can move away from each other, the preheating belt can be cooled down in a short time when the preheating roller is made to move away from the preheating belt in order to lower the temperature of the preheating belt.

Further, in the invention, it is preferable that the preheating belt is made of a thermal conductive material.

According to the invention, the preheating belt has its temperature increasing at high rate and therefore has enhanced thermal conductivity for the toner during the preheating process, thus allowing molten release agent to efficiently spread over an entire toner, with the result that the toner can be more reliably prevented from scattering when entering the pressure-contact area formed between the heating roller and the pressurizing roller. Moreover, the preheating belt may have a temperature efficiently decreasing when cooled down.

Further, the invention provides an image forming method for forming an image by using the image forming apparatus, the image forming method comprising:

a toner image forming step of forming a toner image on a surface of an image forming member;

an attachment amount controlling step of controlling in the toner image forming step so that an amount of toner attached to a recording medium at a coverage rate of 100% is 0.4 mg/cm$^2$ or less;

a transferring step of transferring the toner image to the recording medium;

a preheating step of preheating the unfixed toner image transferred to the recording medium before the unfixed toner image is fixed to the recording medium;

a preheating condition controlling step of controlling a preheating condition in the preheating step; and a fixing step of fixing the unfixed toner image to the recording medium by letting the unfixed toner image preheated pass through a pressure-contact area formed between a heating roller and a pressurizing roller.

According to the invention, the image forming method for forming an image by using the image forming apparatus having the above-described effects, includes a toner image forming step, an attachment amount controlling step, a transferring step, a preheating step, a preheating condition controlling step, and a fixing step. In the toner image forming step, a toner image is formed on a surface of an image forming member. In the attachment amount controlling step, such a control is performed that an amount of toner attached to a recording medium at a coverage rate of 100% is 0.4 mg/cm$^2$ or less in the toner image forming step. In the transferring step, the toner image is transferred to the recording medium. In the preheating step, the recording medium is preheated before an unfixed toner image transferred to the recording medium is fixed to the recording medium. In the preheating condition controlling step, a preheating condition in the preheating step is controlled. In the fixing step, the unfixed toner image is fixed to the recording medium by letting the unfixed toner image preheated pass through a pressure-contact area formed between a heating roller and a pressurizing roller.

The preheating conditions for the preheating step are controlled and under the preheating conditions thus controlled, the unfixed toner on the recording medium is preheated, which unfixed toner indicates a toner transferred but not yet fixed, and further in the attachment amount controlling step, such a control is performed that the amount of toner attached to the recording medium at a coverage rate of 100% is 0.4 mg/cm$^2$ or less in the toner image forming step, with the result that the toner is prevented from scattering when the recording medium carrying the unfixed toner passes through the pressure-contact area formed between the heating roller and the pressurizing roller in the fixing step. In the case where the amount of toner attached to the recording medium at a coverage rate of 100% exceeds 0.4 mg/cm$^2$ or less, the temperature of the unfixed toner image transferred to the recording medium does not rise sufficiently in the preheating step, therefore not causing toner-to-toner fusion, and toner scattering and the like trouble will be caused in the fixing step when the recording medium passes through the pressure-contact area formed between the heating roller and the pressurizing roller, resulting in degraded image quality. Moreover, in this case, the scattering toner will be attached to the heating roller and the pressurizing roller, which contamination of the rollers will lead to more obvious degradation of image quality.

Further, high-quality images can be obtained which are not different in quality depending on sheets and not suffering from a trouble of the toner scattering when the toner enters the pressure-contact area formed between the heating roller and the pressurizing roller.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
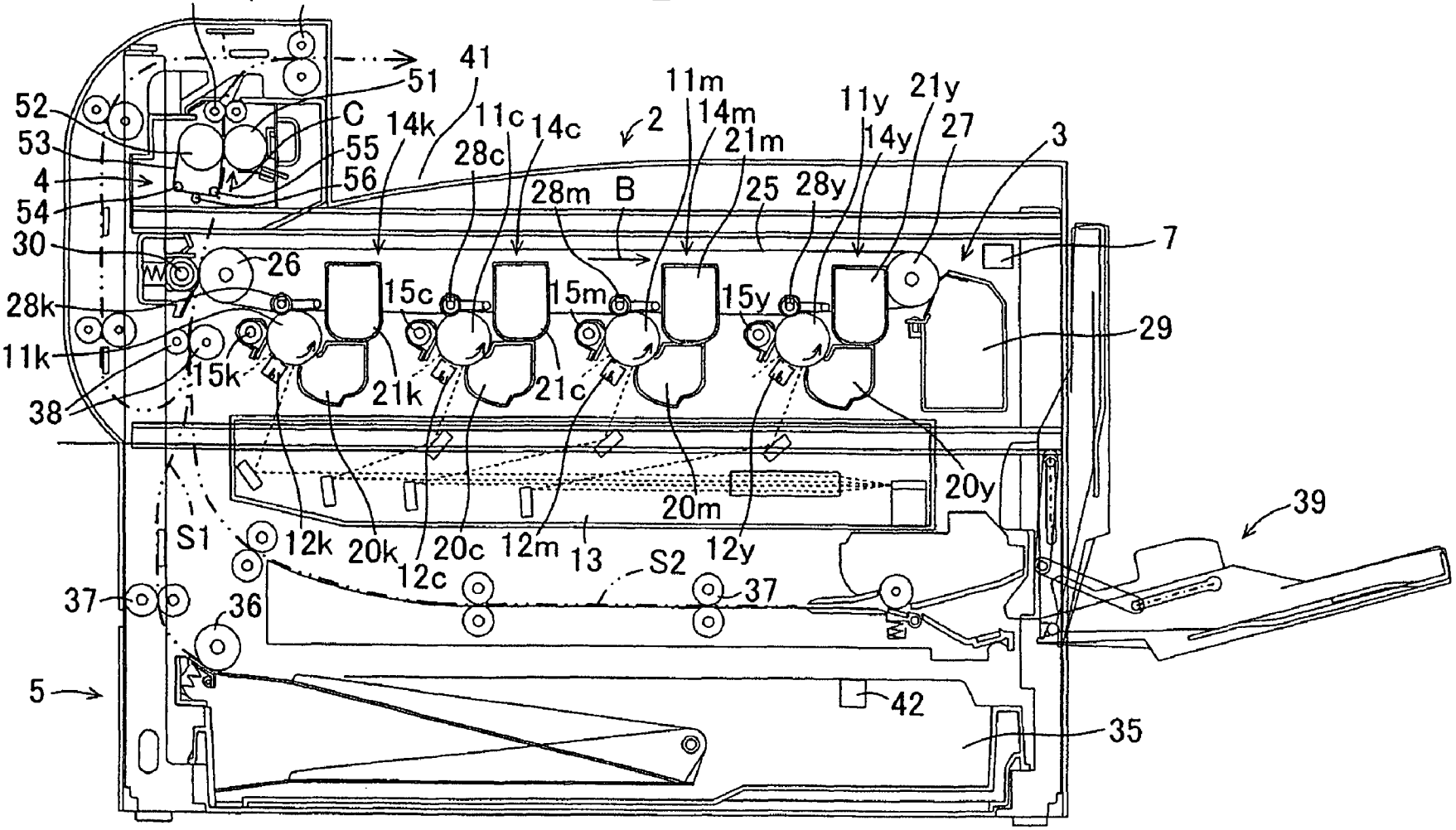
FIG. 1A is a sectional view schematically showing a configuration of an image forming apparatus according to one embodiment of the invention.

Now referring to the drawings, preferred embodiments of the invention are described below.

Figure 1B:
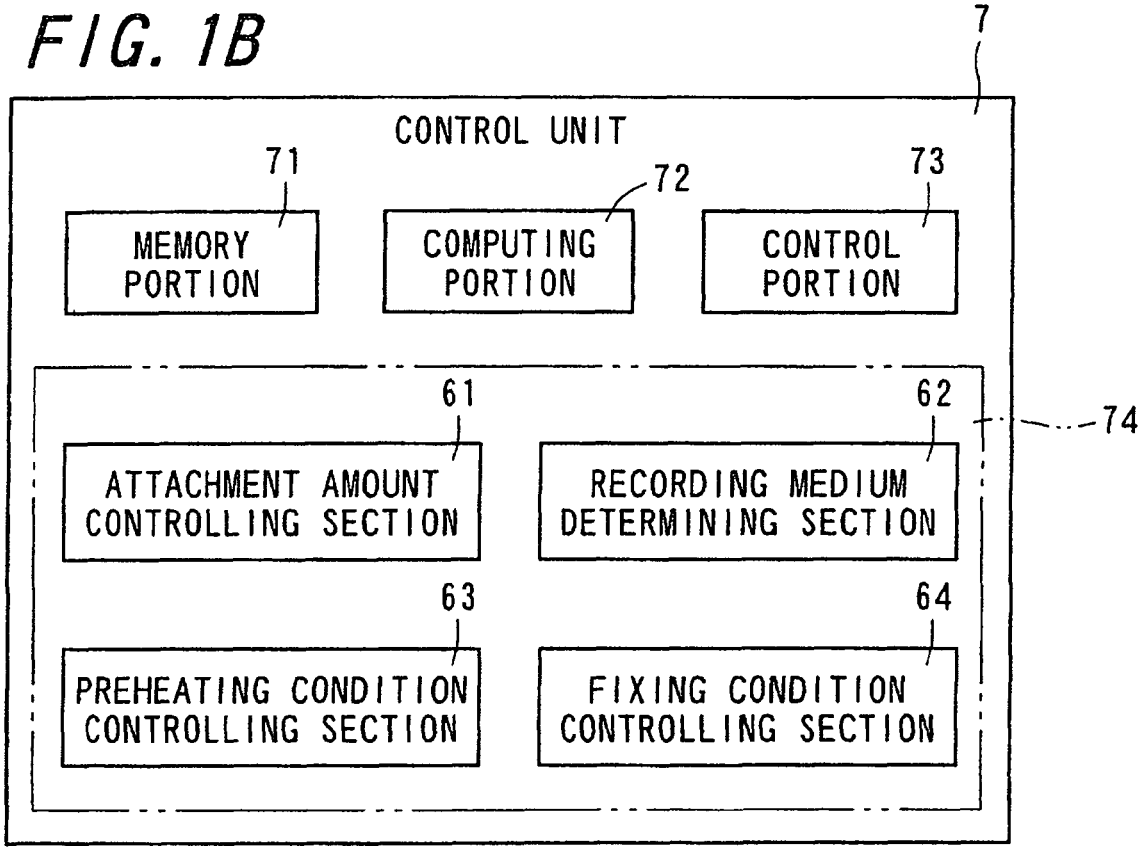
FIG. 1B is a block diagram showing a configuration of a control unit.
Figure 2:
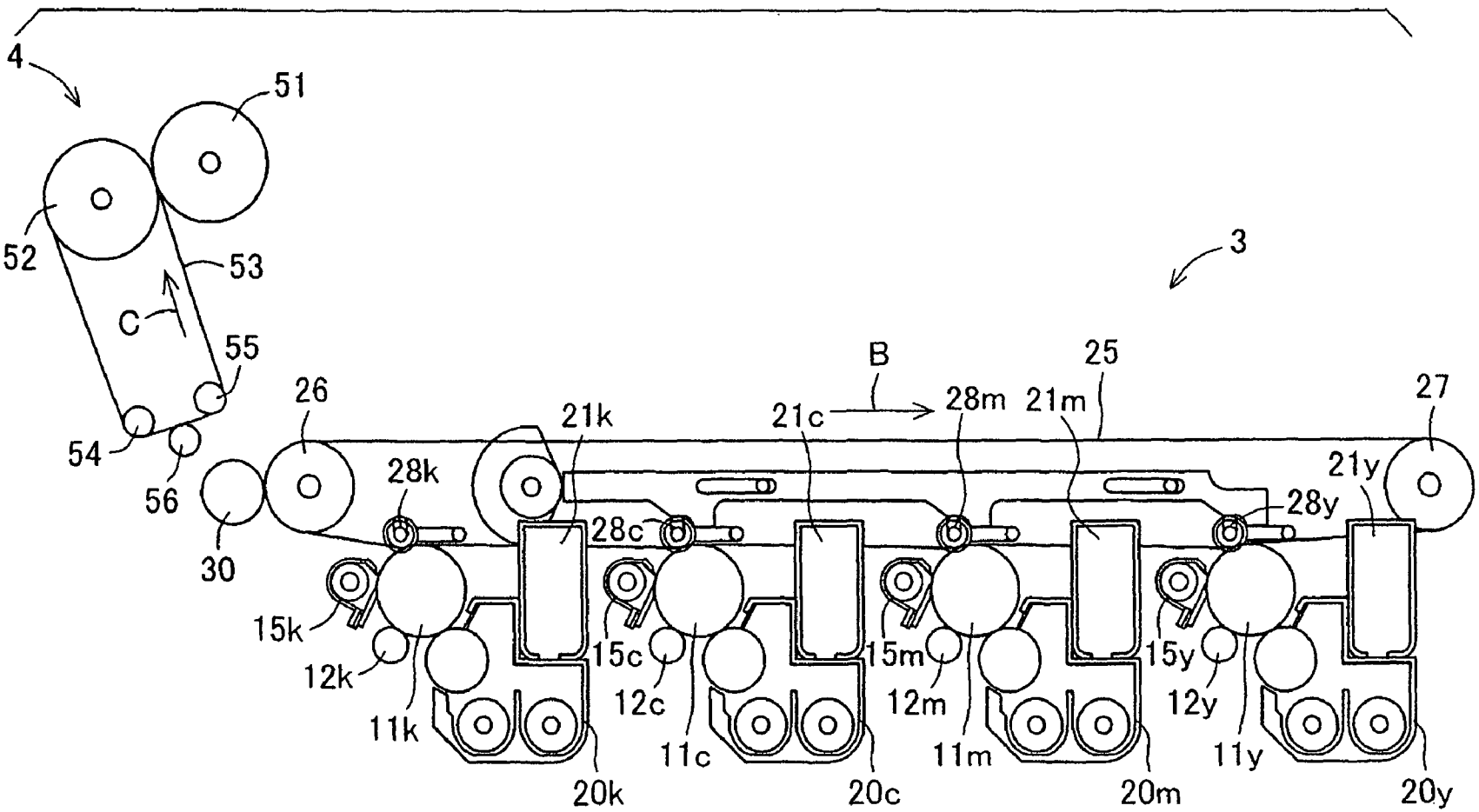
FIG. 2 is a sectional view schematically showing configurations of a transferring section and a fixing section.

FIG. 1A is a sectional view schematically showing a configuration of an image forming apparatus 1 according to one embodiment of the invention, and FIG. 1B is a block diagram showing a configuration of a control unit 7. FIG. 2 is a sectional view schematically showing configurations of a transferring section 3 and a fixing section 4. The image forming apparatus 1 forms, in accordance with image information transmitted thereto, a multicolor or monochrome image on a recording medium. The image forming apparatus 1 includes a toner image forming section 2, a transferring section 3, a fixing section 4, a recording medium supplying section 5, a discharging section 6, and a control unit 7. The control unit 7 is composed of an attachment amount controlling section 61, a recording medium determining section 62, a preheating condition controlling section 63, and a fixing condition controlling section 64. In the toner image forming section 2, a toner image is formed on a surface of a photoreceptor drum 11 serving as an image forming member in a toner image forming step. In accordance with image information of respective colors of black (k), cyan (c), magenta (m), and yellow (y) which are contained in color image information, there are provided respectively four sets of the components constituting the toner image forming section 2 and a part of the components contained in the transferring section 3. The four sets of respective components provided for the respective colors are distinguished herein by giving alphabets indicating the respective colors to the ends of the reference numerals, and in the case where the sets are collectively referred to, only the reference numerals are shown.

The toner image forming section 2 includes the photoreceptor drum 11, a charging section 12, an exposure unit 13, a developing section 14, and a cleaning unit 15. The charging section 12, the exposure unit 13, the developing section 14, and the cleaning unit 15 are disposed in the order just stated around the photoreceptor drum 11. The charging section 12 is disposed below the developing section 14 and the cleaning unit 15 as viewed in a vertical direction.

The photoreceptor drum 11 is rotatably supported around an axis thereof by a driving portion (not shown), and includes a conductive substrate (not shown) and a photosensitive layer formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as of synthetic resin film, metal film, and paper; and a resin composition containing conductive particles and/or conductive polymers. As the film-like substrate used for the conductive film, the synthetic resin film is preferred and a polyester film is particularly preferred. Further, as the method of forming the conductive layer in the conductive film, vapor deposition, coating, etc. are preferred.

The photosensitive layer is formed, for example, by stacking a charge generation layer containing a charge generating substance, and a charge transport layer containing a charge transporting substance. In this case, an undercoat layer is preferably formed between the conductive substrate and the charge generation layer or the charge transport layer. Provision of the undercoat layer offers advantages such as covering the flaws and irregularities present on the surface of the conductive substrate to thereby smooth the surface of the photosensitive layer, preventing degradation of the chargeability of the photosensitive layer during repetitive use, and enhancing the charging property of the photosensitive layer under a low temperature and/or low humidity circumstance. Further, the photosensitive layer may be a laminated photoreceptor having a highly-durable three-layer structure in which a photoreceptor surface-protecting layer is provided on the top layer.

The charge generation layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generation ability and are suitable for obtaining a highly-sensitive photosensitive layer. The charge generating substances may be used each alone, or two or more of the charge generating substances may be used in combination. The content of the charge generating substance is not particularly limited, and preferably from 5 parts by weight to 500 parts by weight and more preferably from 10 parts by weight to 200 parts by weight based on 100 parts by weight of binder resin in the charge generation layer. Also as the binder resin for charge generation layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester.

The binder resins may be used each alone or, optionally, two or more of the resins may be used in combination.

The charge generation layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generation layer, and then applying the coating solution for charge generation layer to the surface of the conductive substrate, followed by drying. The thickness of the charge generation layer obtained in this way is not particularly limited, and preferably from 0.05 μm to 5 μm and more preferably from 0.1 μm to 2.5 μm.

The charge transport layer stacked over the charge generation layer contains as an essential ingredient a charge transporting substance having an ability of receiving and transporting charges generated from the charge generating substance, and binder resin for charge transport layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis (4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, promanyl, chloranyl, and benzoquinone. The charge transporting substances may be used each alone, or two or more of the charge transporting substances may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting substance. As the binder resin for charge transport layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, electrical characteristics etc. of the obtained charge transport layer, it is preferable to use, for example, polycarbonate which contains bisphenol Z as the monomer ingredient (hereinafter referred to as "bisphenol Z polycarbonate"), and an admixture of bisphenol Z polycarbonate and other polycarbonate. The binder resin may be used each alone, or two or more of the binder resins may be used in combination.

The charge transport layer preferably contains an antioxidant together with the charge transporting substance and the binder resin for charge transport layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of the antioxidants may be used in combination. The content of the antioxidant is not particularly limited, and is 0.01% by weight to 10% by weight and preferably 0.05% by weight to 5% by weight of the total amount of the ingredients constituting the charge transport layer. The charge transport layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transport layer, and applying the coating solution for charge transport layer to the surface of a charge generation layer followed by drying. The thickness of the charge transport layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generation layer and the charge transport layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charger, a charger type charger, a saw tooth type charger, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in contact-pressure with the photoreceptor drum 11. It is also possible to use a contact-charging type charger such as a charging brush or a magnetic brush.

The exposure unit 13 is disposed so that light corresponding to respective color information emitted from the exposure unit 13 passes between the charging section 12 and the developing section 14 to reach the surface of the photoreceptor drum 11. In the exposure unit 13, the image information is examined to thereby form branched light corresponding to respective color information of black (k) cyan (c), magenta (m), and yellow (y), and the surface of the photoreceptor drum 11 which has been evenly charged by the charging section 12, is exposed to the light corresponding to the respective color information to thereby form an electrostatic latent image on the surface of the photoreceptor drum 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

The developing section 14 includes a developer tank 20 and a toner hopper 21. The developer tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e., a toner image. The developer tank 20 contains in an internal space thereof the developer, and rotatably supports roller members such as a developing roller, a supplying roller, and an agitating roller, or screw members, which roller or screw members are contained in the developer tank 20. The developer tank 20 has an opening in a side face thereof opposed to the photoreceptor drum 11. The developing roller is rotatably provided at such a position as to face the photoreceptor drum 11 through the opening just stated. The developing roller is a roller-shaped member for supplying a toner to the electrostatic latent image on the surface of the photoreceptor drum 11 in a pressure-contact area or most-adjacent area between the developing roller and the photoreceptor drum 11. In supplying the toner, to a surface of the developing roller is applied potential whose polarity is opposite to polarity of the potential of the charged toner, which serves as development bias voltage (hereinafter referred to simply as "development bias"). By so doing, the toner on the surface of the developing roller is smoothly supplied to the electrostatic latent image. Furthermore, an amount of the toner being supplied to the electrostatic latent image (which amount is also referred to as "toner attachment amount") can be controlled by changing a value of the development bias.

The toner attachment amount is controlled by the attachment amount controlling section 61. A reference range of the toner attachment amount is previously written in a memory portion 71 of the attachment amount controlling section 61. The attachment amount controlling section 61 controls the toner image forming section 2 in the attachment amount controlling step so that the toner attachment amount on the recording medium at a coverage rate of 100% is 0.4 mg/cm$^2$ or less. Further, in forming images with process black made of the toners of three colors; cyan, yellow, and magenta, the attachment amount controlling section 61 controls the toner image forming section 2 so that the amount of toner attached to the recording medium at a coverage rate of 100% is 1.2 mg/cm$^2$ or less for single layer. Later-described preheating conditions are controlled and under the preheating conditions thus controlled, the recording medium carrying an unfixed toner is preheated, which toner indicates a toner transferred but not yet fixed, and the control is further carried out so that the toner attachment amount at a coverage rate of 100% is 0.4 mg/cm$^2$ or less, with the result that the toner is prevented from scattering when the recording medium carrying the unfixed toner image passes through a pressure-contact area formed between the heating roller and the pressurizing roller in a fixing step. In the case where the toner attachment amount on the recording medium at a coverage rate of 100% exceeds 0.4 mg/cm$^2$, a temperature of the toner contained in the unfixed toner image transferred to the recording medium does not rise sufficiently in the preheating step, therefore not causing toner-to-toner fusion, and toner scattering and the like trouble will be caused in the fixing step when the preheated recording medium passes through the pressure-contact area formed between the heating roller and the pressurizing roller, resulting in degraded image quality. Moreover, in this case, the scattering toner will be attached to the heating roller and the pressurizing roller, which contamination of the rollers will lead to more obvious degradation of image quality.

A lower limit of the toner attachment amount is not particularly limited and may be appropriately selected from a range selectable by a person having ordinary skill in the art in accordance with a variety or the like element of an image to be formed. In particular, it is preferable to select the toner attachment amount from the range of 0.25 mg/cm$^2$ to 0.4 mg/cm$^2$. Depending on the coverage rate, the toner attachment amount may be smaller. The reference range of the toner attachment amount is previously written in the memory portion 71 of the attachment amount controlling section 61. In the attachment amount controlling section 61, the toner attachment amount is corrected in accordance with the coverage rate with reference to coverage rate data contained in image information which is written in the memory portion 71. The correction is carried out based on an assumption that the toner attachment amount and the coverage rate are directly proportional to each other. For example, the toner attachment amount at a coverage rate of 100% is defined as the maximum value (e.g. 0.4 mg/cm$^2$) of the reference value. When a coverage rate of an image to be printed is found, an appropriate toner attachment amount can be determined based on the toner attachment amount at a coverage rate of 100%. The toner attachment amount onto a recording medium is thus controlled by the attachment amount controlling section 61.

The toner attachment amount determined is written in the memory portion 71. In the attachment amount controlling section 61, the development bias is made to change, whereby the toner attachment amount is controlled. Since a relation between the value of development bias and the toner attachment amount is previously written in form of data table into the memory portion 71, the data table in the memory portion 71 is referred to by the attachment amount controlling section 61 to determine a value of development bias necessary to obtain the toner attachment amount determined. On a basis of a result thus obtained, a control signal is sent from a control portion 73 of the attachment amount controlling section 61 to a power source (not shown) for applying the development bias to the developing roller, and to the developing roller is applied the development bias of which value has been determined by the attachment amount controlling section 61.

The supplying roller is a roller-shaped member which is rotatably disposed so as to face the developing roller and used to supply the toner to the vicinity of the developing roller. The agitating roller is a roller-shaped member which is rotatably disposed so as to face the supplying roller and used to feed to the vicinity of the supplying roller the toner which is newly supplied from the toner hopper 21 into the developer tank 20. The toner hopper 21 is disposed so that a toner replenishment port (not shown) formed in a vertically lower part of the toner hopper 21 is in communication with a toner reception port (not shown) formed in a vertically upper part of the developer tank 20. The toner hopper 21 replenishes the developer tank 20 with the toner according to toner consumption. Further, it may be possible to adopt such configuration that the developer tank 20 is replenished with the toner supplied directly from a toner cartridge of each color without using the toner hopper 21.

Now, the toner is not particularly limited, and it is possible to use a toner which contains binder resin, a colorant, a release agent, a charge control agent, an external additive, and the like ingredient. For the binder resin, any known resin may be used without particular limitation as long as the binder resin is customarily used as binder resin for toner and can be granulated when fused, including polyvinyl chloride, polyvinyl acetate, polyethylene, polypropylene, polyester, polyamide, styrene-based polymer, (meth)acrylic resin, polyvinyl butyral, silicone resin, polyurethane, epoxy resin, phenolic resin, xylene resin, rosin modified resin, teepee resin, aliphatic hydrocarbon resin, alicyclic hydrocarbon resin, aromatic petroleum resin, chlorinated paraffin, and paraffin wax, for example. The binder resin may be used each alone, or two or more of the binder resins may be used in combination. Among those materials, it is preferable to use polyester, styrene-based polymer, (meth)acrylic resin, and the like ingredient, of which particle surfaces easily become smooth through wet granulation with use of aqueous liquid.

As the polyester, a polycondensation product of polyhydric alcohol and polyhydric carboxylic acid is preferred. Examples of the polyhydric alcohol include: aliphatic alcohol such as ethylene glycol, propylene glycol, 1,3-butanediol, 1,4-butanediol, 2,3-butanediol, diethylene glycol, 1,5-pentanediol, 1,6-hexanediol, or neopentyl glycol; alicylic alcohol such as cyclohexane dimethanol or hydrogenated bisphenol; and a bisphenol A alkylene oxide adduct such as a bisphenol A ethylene oxide adduct or a bisphenol A propylene oxide adduct. One or two or more of the polyhydric alcohols may be used. Examples of the polyhydric carboxylic acid include: aromatic carboxylic acid such as phthalic acid, terephthalic acid, or phthalic anhydride, and acid anhydride thereof; and saturated and unsaturated aliphatic carboxylic acid such as succinic acid, adipic acid, sebacic acid, azelaic acid, or dodecenyl succinic acid, and acid anhydride thereof. One or two or more of the polyhydric carboxylic acid may be used.

Examples of the styrene-based polymer include: a homopolymer of a styrene-based monomer; and a copolymer of a styrene-based monomer and a monomer polymerizable with the styrene-based monomer. Examples of the styrene-based monomer include styrene, o-methylstyrene, ethylstyrene, p-methoxystyrene, p-phenylstyrene, 2,4-dimethylstyrene, p-n-octylstyrene, p-n-decylstyrene, and p-n-dodecylstyrene. Example of the monomer polymerizable with styrene-based monomer include: (meth)acrylic esters such as methyl(meth)acrylate, ethyl(meth)acrylate, propyl(meth)acrylate, butyl(meth)acrylate, isobutyl(meth)acrylate, n-octyl(meth)acrylate, dodecyl(meth)acrylate, 2-ethylhexyl(meth)acrylate, stearyl(meth)acrylate, phenyl(meth) acrylate, and dimethylaminoethyl(meth)acrylate; (meth) acrylic monomers such as acrylonitrile, methacrylamide, glycidyl methacrylate, N-methylolacrylamide, N-methylolmethacrylamide, and 2-hydroxyethylacrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; and N-vinyl compounds such as N-vinyl pyrrolidone, N-vinylcarbazole, and N-vinylindole. One or two or more of the styrene-based ionomer may be used, and one or two or more of the monomer polymerizable with the styrene-based monomer may be used.

Examples of the (meth)acrylic resin include: a homopolymer of (meth)acrylic esters; and a copolymer of (meth)acrylic esters and a monomer polymerizable with the (meth)acrylic esters. Usable examples of (meth)acrylic esters are those cited above. Examples of the monomer polymerizable with the (meth)acrylic esters include: (meth)acrylic monomers, vinyl ethers, vinyl ketones, and N-vinyl compounds. Usable examples of each of these ingredients are those cited above.

Note that binder resin self-dispersible in water may also be used which resin has a main chain or side chain bonded to a hydrophilic radical such as a carboxyl group or a sulfonate group.

As the colorant, it is possible to use a black pigment or a chromatic pigment, for example. The black colorant includes, for example: a black inorganic pigment such as carbon black, copper oxide, manganese dioxide, activated carbon, non-magnetic ferrite, magnetic ferrite, and magnetite; and a black organic pigment such as aniline black.

Examples of the chromatic pigment include: a yellow inorganic pigment such as yellow lead, zinc yellow, cadmium yellow, yellow iron oxide, mineral fast yellow, nickel titanium yellow, or navel yellow; a yellow organic pigment such as naphthol yellow S, hanza yellow G, hanza yellow 10G, benzidine yellow G, benzidine yellow GR, quinoline yellow lake, permanent yellow NCG, or tartrazine lake; an orange inorganic pigment such as red lead yellow or molybdenum orange; an orange organic pigment such as permanent orange GTR, pyrazolone orange, vulcan orange, indanthrene brilliant orange RK, benzidine orange G, or indanthrene brilliant orange GK; a red inorganic pigment such as red iron oxide, cadmium red, red lead oxide, mercury sulfide, or cadmium; a red organic pigment such as permanent red 4R, lysol red, pyrazolone red, watching red, calcium salt, lake red C, lake red D, brilliant carmine 6B, eosin lake, rhodamine lake B, alizarin lake, and brilliant carmine 3B; a purple inorganic pigment such as manganese purple; a purple organic pigment such as fast violet B or methyl violet lake; a blue inorganic pigment such as Prussian blue or cobalt blue; a blue organic pigment such as alkali blue lake, Victoria blue lake, phthalocyanine blue, non-metal phthalocyanine blue, phthalocyanine blue-partial chlorination product, fast sky blue, or indanthrene blue BC; a green inorganic pigment such as chromium green or chromium oxide; and a green organic pigment such as pigment green B, malachite green lake, or final yellow green G.

One or two or more of the colorant may be used. Two or more of the colorants with the same color may be used, or two or more of the colorants of different colors may be used in combination. A content of the colorant is preferably 1% by weight to 20% by weight and more preferably 0.2% by weight to 10% by weight of a total amount of the toner.

As the release agent, materials used customarily in the relevant field can be used including, for example: petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amide and phenolic fatty acid ester; long-chain carboxylic acid and derivatives thereof; long-chain alcohol and derivatives thereof; a silicone polymer; and higher fatty acid. Note that examples of the derivatives include an oxide, a block copolymer of a vinylic monomer and wax, and a graft-modified derivative of a vinylic monomer and wax. A usage of the release agent may be appropriately selected from a wide range without particular limitation, and preferably 0.2% by weight to 20% by weight of the total amount of the toner.

A melting temperature of the release agent is preferably 80° C. or less. In the case where the melting temperature of the toner is 80° C. or less, only small heat quantity is required for the preheating process, and the toner-to-toner fusion is more easily attained, with the result that the toner can be furthermore prevented from scattering when entering the pressure-contact area formed between the heating roller and the pressurizing roller so that high-resolution images can be more stably formed without the toner scattered.

Examples of the charge control agent include a charge control agent for negative electric toner, including metal-containing azo dye such as chrome-azo complex dye, iron-azo complex dye, or cobalt-azo complex dye; copper phthalocyanine dye; metal complexes and salts thereof which contain chrome, zinc, aluminum, boron, or the like metal, of salicylic acid and an alkyl derivative thereof; metal complexes and salts thereof which contain chrome, zinc, aluminum, boron, or the like metal, of naphthol acid and a derivative thereof; metal complexes and salts thereof which contain chrome, zinc, aluminum, boron, or the like metal, of benzilic acid and a derivative thereof; long-chain alkylcarboxylate salt; and long-chain alkylsulfonate salt; nigrosine dye and a derivative thereof; benzoguanamine and a derivative thereof; a triphenylmethane derivative; quaternary ammonium salt; quaternary phosphonium salt; quaternary pyridinium salt; guanidine salt; amidine salt; and radical polymerization copolymers of monomers having nitrogen-containing functional groups, which monomers include N,N-dialkylaminoalkyl(meth)acrylates such as N,N-dimethylaminomethyl (meth)acrylate, N,N-dimethylaminoethyl(meth)acrylate, and N,N-diethylaminoethyl(meth)acrylate, and N,N-dialkylaminoalkyl(meth)acrylamides such as N,N-dimethylaminoethyl (meth)acrylamide, and N,N-dimethylaminopropyl(meth) acrylamide. One or two or more of the charge control agent may be used. A content of the charge control agent is preferably 0.1% by weight to 5.0% by weight of the total amount of the toner.

The toner can be manufactured in a melting/kneading/pulverizing process, for example. In the melting/kneading/pulverizing process, the toner can be manufactured in a manner that the binder resin, the colorant, the release agent, the charge control agent, and the other additives are measured respectively and predetermined amounts thereof are then dry-mixed with each other into an admixture; the admixture thus obtained is then molten and kneaded into molten and kneaded materials; the molten and kneaded materials thus obtained are then cooled down into a solidified product; and the solidified product thus obtained is then mechanically pulverized. A mixer to be used for the dry-mixing step include, for example, a Henschel-type mixing device such as Henschel mixer (trade name) manufactured by Mitsui Mining Co., Ltd., Supermixer (trade name) manufactured by Kawata MFG Co., Ltd., or Mechanomill (trade name) manufactured by Okada Seiko Co., Ltd.; Angmill (trade name) manufactured by Hosokawa Micron Corporation; Hybridization system (trade name) manufactured by Nara Machinery Co., Ltd.; and Cosmo system (trade name) manufactured by Kawasaki Heavy Industries Co., Ltd.

In the kneading operation, the admixture is agitated on heating at temperature normally around 80° C. to 200° C., preferably around 100° C. to 150° C., which temperature is equal to or higher than a melting temperature of the binder resin. A usable example of kneader includes a commonly-used kneader such as a twin-screw extruder, a three roll mill, or laboplast mill. A specific example of such a kneader is a single or twin screw extruder such as TEM-100B (trade name) manufactured by Toshiba Kikai Co., Ltd., or PCM-65/87 (trade name) manufactured by Ikegai Co.; or an open roll-type kneading machine such as Kneadex (trade name) manufactured by Mitsui Mining Co, Ltd. Among these kneaders, the open roll-type kneading machine is preferred. The solidified product resulting from the cooling of the molten and kneaded materials is pulverized by a cutter mill, a feather mill, a jet mill, or the like device. For example, the solidified product is coarsely pulverized with the cutter mill and then pulverized with the jet mill, thus resulting in a toner having a desired volume average particle size. The toner thus obtained may be treated with a classification process. In the classification process using, for example, a rotary classifier, fine particles having an undesirably small volume average particle size and coarse particles having an undesirably large volume average particle size can be removed from the toner obtained.

Among the toners obtained as above, the toner preferably used in the image forming apparatus 1 has a volume average particle size of 3 μm or more and 8 μm or less with a shape factor SF2 of 140 or more and less than 145. Further, it is more preferable to use the toner having a volume average particle size of 5 μm or more and 7 μm or less. The toner having a volume average particle size of 3 μm or more and 8 μm or less with a shape factor SF2 of 140 or more and less than 145 can be stably supplied to the photoreceptors and further prevented from scattering and moreover, in the preheating process, sufficient toner-to-toner fusion can be attained, so that high-resolution images can be stably formed without the toner scattered.

When used in the image forming apparatus 1, a toner having a volume average particle size of less than 3 μm is too small in particle size and therefore may be too much charged and less flowable. When the toner is too much charged and less flowable, the toner is not allowed to be stably supplied to the photoreceptors, which situation may cause a background fog, a decrease in image density, and the like trouble. A toner having volume average particle size of more than 8 μm is too large in particle size to form a high-resolution image. In addition, a toner having a larger particle size has a smaller specific surface area and therefore is less charged per unit volume of the toner. The toner less charged per unit volume thereof cannot be stably fed to the photoreceptors and may scatter in the apparatus, thus causing contamination. Moreover, such a toner has the larger number of air gaps and undesirably leads to an increase in the toner attachment amount on a recording medium at a coverage rate of 100%, resulting in more obvious degradation of image quality due to the toner scattering when the toner enters the pressure-contact area between the heating roller and the pressurizing roller.

The volume average particle size is determined as follows. To 50 ml of electrolyte solution: ISOTON II (trade name) manufactured by Beckman Coulter, Inc. are added 20 mg of a sample and 1 ml of sodium salt of alkyl ether sulfate, which are then subjected to a dispersion treatment at ultrasonic frequency of 20 kHz for three minutes by an ultrasonic dispersing machine: UH-50 (trade name) manufactured by SMT Co., Ltd., whereby a measurement sample is prepared. The measurement sample is analyzed by a particle size distribution-measuring device: Multisizer II (trade name) manufactured by Beckman Coulter, Inc., under the conditions that an aperture size is 100 μm and the number of particles for measurement is 50,000 counts. Through the analysis, a volume particle size distribution of the sample particles is obtained, from which distribution the volume average particle size can be determined.

The shape factor SF2 is determined by the following expression (1) and represents an irregularity degree of toner shape. A toner having a shape factor SF2 of 100 has no surface irregularity, and a toner having a larger shape factor SF2 has more obvious surface irregularity.

When used in the image forming apparatus 1, a toner having a shape factor SF2 of less than 140 has toner particles easily falling from a toner layer before the preheating step, and may cause toner scattering. A toner having a shape factor SF2 of 145 or more has larger air gaps among toner particles in a toner layer and during the preheating step, a temperature of the toner transferred but not yet fixed onto a recording medium does not rise sufficiently, thus failing to attain sufficient toner-to-toner fusion.

The shape factor SF2 is defined as a value determined in the following method. On surfaces of the toner particles, metal films are formed (that are Au films each having a thickness of 0.5 μm) by the sputtering deposition. From the metal film-coated toners thus obtained, 200 to 300 toners are randomly extracted and photographed at accelerating voltage of 5 kV and at 1,000-fold magnification by a scanning electron microscope. S-570 (trade name) manufactured by Hitachi Ltd. Thus-obtained data of electron micrograph is image-analyzed by use of an image analysis software: A-zo kun (trade name) manufactured by Asahi Kasei Engineering Corporation. Parameters for analyzing particles, used in the image analysis software "A-zo kun", are set as follows: small graphic-removed area has 100 pixels; the number of contraction and separation process is one; the number of small graphics is one; the number of executions is ten; no noise-cancelling filter is disposed; no shading compensation is carried out; and a unit for indicating a result is "μm". On the basis of a peripheral length PERI and a graphic area AREA of a toner particle thus obtained, the shape factor SF2 is determined by the following expression (1):

$$SF2=[(PERI)^2/AREA]\times(100/4\pi) \quad (1)$$

In order to efficiently manufacture the above toner having a volume average particle size of 3 μm or more and 8 μm or less with a shape factor SF2 of 140 or more and less than 145, a spheronization process is applied to at least a part of toner particles contained in a toner having a shape factor SF2 of 145 or more, for example. The toner having a shape factor SF2 of 145 or more is obtained in, for example, the above-mentioned melting/kneading/pulverizing process. That is to say, the toner having a volume average particle size of 3 μm or more and 8 μm or less with a shape factor SF2 of 140 or more and less than 145 can be efficiently manufactured when the toner for use in the image forming apparatus 1 contains a plurality of toner particles having a shape factor SF2 of 145 or more that are obtained in the melting/kneading/pulverizing process, and at least a part of the above toner particles are treated with the spheronization process.

Examples of the toner spheronizing device include an impact-type spheronizing device and a hot-air-type spheronizing device. A usable example of the impact-type spheronizing device is a commercially-available device including Faculty (trade name) manufactured by Hosokawa Micron Corporation, and Hybridization system (trade name) manufactured by Nara Machinery Co., Ltd. Alternatively, a usable example of the hot-air-type spheronizing device is a commercially-available device including Meteo Rainbow (trade name) manufactured by Nippon Pneumatic MFG. Co., Ltd.

Further, in the image forming apparatus 1, it is preferable to use a toner having an average degree of circularity of 0.950 or more and 0.985 or less. A toner having an average degree of circularity of less than 0.950 has the larger number of air gaps, and the larger amount of the toner is attached to a recording medium at a coverage rate of 100%, resulting in more obvious degradation of Image quality due to the toner scattering when the toner enters the pressure-contact area between the heating roller and the pressurizing roller. Furthermore, such a toner lowers the transferring property. A toner having an average degree of circularity exceeding 0.985 will degrade the cleaning property which is thus incompatible with the transferring property.

The use of the toner as described above allows both of a decrease in a running cost for image formation and formation of a high-quality image with good image density and high color saturation.

Further, the degree of circularity (ai) of the toner is defined by the following expression (2). The degree of circularity (ai) as defined by the expression (2) is determined by using a flow particle image analyzer: FPIA-3000 manufactured by Sysmex Corporation. Moreover, a sum of respective degrees of circularity (ai) of "m" pieces of toners is divided by the number "m" of the toners as in the following expression (3) to obtain an arithmetic mean value which is defined as an average degree of circularity (a).

$$\text{Degree of circularity } (ai)=(\text{Peripheral length of circle having the same projection area as that of particle image})/(\text{Length of circumference of projection image of particles}) \quad (2)$$

$$\text{Average degree of circularity } (a)=\sum_{i=1}^{m} ai/m \quad (3)$$

The toner as above can be manufactured in another manner, for example, such that a solidified product of molten and kneaded materials is coarsely pulverized; a coarsely pulverized product thus obtained is turned into aqueous slurry; the aqueous slurry thus obtained is processed into fine particles through a high-pressure homogenizer; and the fine particles thus obtained is heated in aqueous vehicle to be thereby coagulated and molten. The solidified product of molten and kneaded materials is coarsely pulverized by a jet mill, a hand mill, and the like device. As a result of the coarse pulverization, coarse particles having particle sizes of around 100 μm to 3 μm are obtained. The coarse particles are dispersed in water, whereby the aqueous slurry is prepared. In order to prepare the aqueous slurry having coarse particles evenly dispersed, an appropriate amount of a dispersant such as sodium dodecylbenzenesulfonate may have been dissolved in water before the coarse particles are dispersed in the water, for example. When the aqueous slurry thus obtained is processed by the high-pressure homogenizer, the coarse particles in the aqueous slurry are turned into fine particles, thus resulting in the aqueous slurry which contains fine particles having a volume average particle size of around 0.4 μm to 1.0 μm. The aqueous slurry thus obtained is heated to have the fine particles coagulated, molten, and thus adhering to each other. As a result, a toner is obtained having a desired volume average particle size and a shape factor SF2. The volume average particle size and the shape factor SF2 may be set at desired level by appropriately selecting a heating temperature and a heating duration of the aqueous slurry containing the fine particles. The heating temperature is selected from a range from the softening temperature of the binder resin to a temperature of less than a decomposition temperature of the binder resin. In general, the higher the heating temperature is, the larger the volume average particle size of the toner obtained is, on the condition that the heating duration is equal.

As the high-pressure homogenizer, those available on the market are known. Examples of the commercially available high-pressure homogenizer include chamber-type high-pressure homogenizers such as Micofluidizer (trade name) manufactured by Microfluidics Corporation, Nanomizer (trade name) manufactured by Nanomizer Inc., and Ultimizer (trade name) manufactured by Sugino Machine Ltd., High-pressure homogenizer (trade name) manufactured by Rannie Inc., High-pressure homogenizer (trade name) manufactured by Sanmaru Machinery Co., Ltd., High-pressure homogenizer (trade name) manufactured by Izumi Food Machinery Co., Ltd., and NANO 3000 (trade name) manufactured by Beryu Co., Ltd.

To the toner obtained as above, a fluidity enhancer may be externally added for improving toner fluidity. As the fluidity enhancers, heretofore known substances can be used, including silicon oxide, titanium oxide, silicon carbide, aluminum oxide, calcium carbonate, barium titanate, strontium titanate, metal stearate particles, fluorine resin particles, and acrylic resin particles. The fluidity enhancer may be used alone, or two or more of the fluidity enhancers may be used in combination. A usage of the fluidity enhancer is not particularly limited and preferably 0.1 part by weight to 3.0 parts by weight based on 100 parts by weight of the toner.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 1 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging device. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing section 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

FIG. 2 is a sectional view schematically showing configurations of the transferring section 3 and the fixing section 4. In the transferring section 3, the toner image formed on the surface of the photoreceptor drum 11 is transferred onto a recording medium in a transferring step. The transferring section 3 is disposed above the photoreceptor drum 11 as viewed in a vertical direction thereof, and includes the intermediate transfer belt 25, a driving roller 26, a driven roller 27, an intermediate transferring roller 28 (k, c, m, y), a transfer belt cleaning unit 29, and a transferring roller 30. The intermediate transfer belt 25 is an endless belt stretched out by the driving roller 26 and the driven roller 27, thereby forming a loop-shaped travel path. The intermediate transfer belt 25 rotates in a direction of an arrow B. When the intermediate transfer belt 25 passes by the photoreceptor drum 11 in contact therewith, the transfer bias whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed by the respective photoreceptor drums 11 are sequentially transferred onto the intermediate transfer belt 21 and combined thereon, thus forming a multicolor image.

The driving roller 26 can rotate around an axis thereof with the aid of a driving portion (not shown), and the rotation of the driving roller 26 drives the intermediate transfer belt 25 to rotate in the direction of the arrow B. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a driving portion (not shown). The intermediate transfer belt 28 is connected to a power source (not shown) for applying the transfer bias as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contact with an outer circumferential surface of the intermediate transfer belt 25. The toner which is attached to the intermediate transfer belt 25 by contact with the photoreceptor drum 11 may cause contamination on a reverse side of a recording medium. This is why the transfer belt cleaning unit 29 removes and collects the toner on the surface of the intermediate transfer belt 25.

The transferring roller 30 is disposed in pressure-contact with the driving roller 26 across the intermediate transfer belt 25, and capable of rotating around its own axis by a driving portion (not shown). In a pressure-contact area (a transfer nip area) between the transferring roller 30 and the driving roller 26, a toner image which has been carried by the intermediate transfer belt 25 and thereby conveyed to the pressure-contact area is transferred onto a recording medium fed from the later-described recording medium supplying section 5. The recording medium carrying the toner image is fed to the fixing section 4. In the transferring section 3, the toner image is transferred from the photoreceptor drum 11 onto the intermediate transfer belt 25 in the pressure-contact area between the photoreceptor drum 11 and the intermediate transferring roller 28, and by the intermediate transfer belt 25 rotating in the direction of the arrow B, the transferred toner image is conveyed to the transfer nip area where the toner image is transferred onto the recording medium.

The recording medium supplying section 5 includes an automatic paper feed tray 35, a pickup roller 36, a conveying roller 37, a registration roller 38, a manual paper feed tray 39, and a surface roughness detecting sensor 42. The automatic paper feed tray 35 is disposed in a vertically lower part of the image forming apparatus 1 and in form of a container-shaped member for storing the recording mediums. Examples of the recording medium include, for example, plain paper, color copy paper, sheets for over head projector, and post cards. The recording sheets such as the plain paper and the color copy paper is classified according to surface roughness thereof: the recording sheets having surface roughness of 3 μm to 8 μm are categorized into standard paper; the recording sheets having surface roughness of less than 3 μm are categorized into smooth paper; and the recording sheets having surface roughness of more than 8 μm are categorized into rough paper. The standard paper includes, mainly, copy paper which is commercially available in general. The smooth paper includes, mainly, coated paper. The rough paper includes, mainly, recycled paper. The pickup roller 36 takes out sheet by sheet the recording mediums stored in the automatic paper feed tray 35, and feeds the recording mediums to a paper conveyance path S1. The conveying roller 37 is a pair of roller members disposed in pressure-contact with each other, and conveys the recording medium to the registration roller 38. The registration roller 38 is a pair of roller members disposed in pressure-contact with each other, and feeds to the transfer nip area the recording medium fed from the conveying roller 37 in synchronization with the conveyance of the toner image carried on the intermediate transfer belt 25 to the transfer nip area. The manual paper feed tray 39 is a device for storing recording mediums which are different from those stored in the automatic paper feed tray 35 and have any size so as to take the recording medium into the image forming apparatus 1. The recording medium taken in from the manual paper feed tray 39 passes through a paper conveyance path S2 by use of the conveying roller 37, thereby being fed to the registration roller 38. The surface roughness detecting sensor 42 is disposed above the recording mediums inside the automatic paper feed tray 35.

The surface roughness detecting sensor 42 detects surface roughness of a recording medium, and a detected result thereof is inputted to a memory portion 71 of later-described recording medium determining section 62. A usable example of the surface roughness detecting sensor 42 is a commonly-used surface roughness detecting sensor which has a light-emitting portion for emitting light to a recording medium and detects a light reflected by the recording medium to convert the light into surface roughness. Such detection of surface roughness through the above sensor complies with JIS B0601-1994. In the recording medium supplying section 5, recording mediums supplied thereto sheet by sheet from the automatic paper feed tray 35 or the manual paper feed tray 39 are fed to the transfer nip area in synchronization with the conveyance of the toner image carried on the intermediate transfer belt 25 to the transfer nip area. At the same timer the surface roughness of the recording medium is detected by the surface roughness detecting sensor 42 and written in the memory portion 71 of the recording medium determining section 62.

Figure 3:
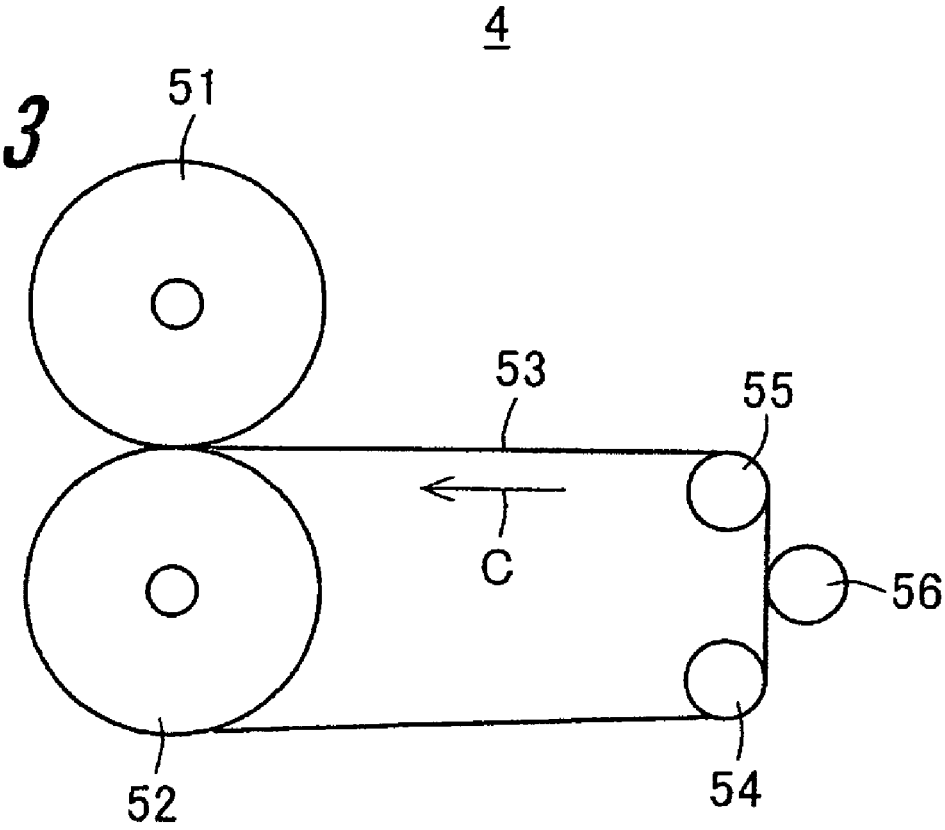
FIG. 3 is a sectional view schematically showing a configuration of the fixing section.

FIG. 3 is a sectional view schematically showing a configuration of the fixing section 4. The fixing section 4 is provided downstream of the transferring section 3 along a conveyance direction of the recording medium. After passing through the transfer nip area and having the toner image transferred, the recording medium is previously heated by the preheating section in the preheating step to have the toner image fixed thereto by the fixing section 4. The preheating section includes a preheating belt 53, support rollers 54 and 55, and a preheating roller 56. The preheating belt 53 is an endless belt stretched out by the pressurizing roller 52 and the support rollers 54 and 55, thereby forming a loop-shaped travel path. The preheating belt 53 rotates an a direction of an arrow C. The recording medium is carried on the preheating belt 53 and conveyed to the pressure-contact area between the heating roller 51 and the pressurizing roller 52. When the preheating belt 53 passes by the preheating roller 56 in pressure-contact therewith, the preheating belt 53 is heated by the preheating roller 56, with the result that the recording medium carried on the preheating belt 53 thus heated is also heated. In this way, the unfixed toner on the recording medium is heated.

The preheating belt 53 is on the pressurizing roller 52 in the fixing section 4 to thereby serve as not only the preheating section but also a conveying section for conveying a recording medium carrying an image transferred thereto, causing an effect that a difference between a conveying speed and a fixing speed is eliminated. In addition, since the preheating belt 53 is in contact with the heating roller 51 in the fixing section 4, the preheating belt 53 has a temperature maintained at a certain degree so that heat quantity for preheating can be small.

Further, the preheating belt 53 is preferably heated in contact with the preheating roller 56. In this case, the preheating belt 53 can be easily cooled down. Accordingly, for example, in the case of printing on a thinner recording medium immediately after printing on a thicker recording medium, the temperature of the preheating belt 53 can be easily lowered, thus allowing for continuous printing on different temperature conditions. Since the preheating roller 56 and the preheating belt 53 can move away from each other, the preheating belt 53 can be cooled down in a short time when the preheating roller 56 is made to move away from the preheating belt 53 in order to lower the temperature of the preheating belt 53.

Further, the preheating belt 53 is preferably made of a thermal conductive material. In this case, the preheating belt 53 has its temperature increasing at high rate and therefore has enhanced thermal conductivity for the toner during the preheating process, thus allowing molten release agent to efficiently spread over an entire toner, with the result that the toner can be more reliably prevented from scattering when entering the pressure-contact area formed between the heating roller 51 and the pressurizing roller 52. Moreover, the preheating belt 53 may have a temperature efficiently decreasing when cooled down.

The preheating condition for the preheating section is controlled by the preheating condition controlling section 63 in a preheating condition controlling step. In the preheating condition controlling section 63, the preheating condition is controlled in accordance with usage environment and recording medium-related information that is called a recording medium determination result. By controlling the preheating condition depending on the usage environment or coverage rate, and kind and size of a recording medium, etc., the heating operation can be carried out on the right condition for the recording medium, so that favorable images can be obtained.

The coverage rate represents a ratio of a region to which the toner is attached, in the entire image region of a recording medium. For example, a coverage rate of solid printing is 100%.

The recording medium determination result indicates a result determined by the recording medium determining section 62. According to the detection result of the surface roughness detecting sensor 42, the recording medium determining section 62 determines whether the recording medium is standard paper, smooth paper, or rough paper. The surface roughness detecting sensor 42 is disposed inside the automatic paper feed tray 35. Surface roughness is detected of a recording medium which is placed on top of the recording mediums for image formation so as to be fed in a next image forming operation. The detection result of the surface roughness detecting sensor 42 is inputted to the recording medium determining section 62 and written in the memory portion 71 of the recording medium determining section 62. After the detection result of the surface roughness detecting sensor 42 (hereinafter referred to as "surface roughness detection result") is inputted to the memory portion 71 of the recording medium determining section 62, a program of the recording medium determining section 62 is developed in a computing portion 72 to start to determine the recording medium. In the recording medium determining section 62, values of surface roughness of standard paper (having surface roughness of 3 μm to 8 μm), smooth paper (having surface roughness of less than 3 μm), and rough paper (having surface roughness of more than 8 μm) previously written in the memory portion 71 are compared with the surface roughness detection result which has been also written in the memory portion 71, and it is thus determined which kind of paper has surface roughness range that covers the surface roughness detection result, whereby a kind of the recording medium is determined.

The determination result thus obtained is inputted to the memory portion 71 of the preheating condition controlling section 63. The input of the determination result to the memory portion 71 of the preheating condition controlling section 63 starts up the preheating condition controlling section 63 in the computing portion 72. Note that a recording medium determining button may be provided on a display panel (not shown) installed on a vertically upper surface of the image forming apparatus 1 so that a user can input a kind of recording medium to the preheating condition controlling section 63 based on surface roughness of the recording medium in the case where the surface roughness of the recording medium can be recognized by a user in advance. In the case where an input result given by a user is present, the recording medium determining section 62 preferably determines the recording medium after ensuring that the detection result of the surface roughness detecting sensor 42 corresponds with the input result given by the user. The determination may also be carried out based on only the input result given by a user.

The preheating condition includes a preheating temperature. The preheating temperature is therefore controlled in the preheating condition controlling section 63 according to the recording medium determination result. The heating temperature herein indicates a surface temperature of the preheating roller 56. To the memory portion 71 of the preheating condition controlling section 63, a reference range of the preheating temperature has been inputted in advance for each kind of recording mediums determined based on surface roughness thereof. The reference range of the preheating temperature is 90° C. to 120° C. for standard paper, 80° C. to 110° C. for smooth paper, and 100° C. to 130° C. for rough paper. Moreover, a relation between the coverage rate and the preheating temperature is inputted in form of data table to the memory portion 71 for each kind of recording mediums determined based on surface roughness thereof. Furthermore, to the memory portion 71, there is also inputted a detection result given by a temperature sensor provided in the vicinity of the surface of the preheating roller 56 (that is, a detection result of surface temperature of the preheating roller 56). In the preheating condition controlling section 63 which is started up upon the input of the recording medium determination result to the memory portion 71, the reference range of the preheating temperature in the memory portion 71 is firstly referred to on the basis of the recording medium determination result. And then, by reference to the data of coverage rate and the data table indicating the relation between the coverage rate and the preheating temperature in the memory portion 71, the preheating temperature is determined.

Next, the detection result of the temperature sensor in the memory portion 71 is referred to and compared with the preheating temperature determined as above. In the case where a comparison result thus obtained is that the determined preheating temperature is higher than the detection result, a control signal is transmitted from the control portion 73 of the preheating condition controlling section 63 to a power source (not shown) which is incorporated in the preheating roller 56 and applies voltage to the preheating section to develop heat, to thereby effect such voltage application that the surface temperature of the preheating roller 56 rises up to the determined preheating temperature.

In the case where a comparison result obtained as above is that the determined preheating temperature is lower than the detection result, a control signal is transmitted from the control portion 73 of the preheating condition controlling section 63 to a driving source which drives an exhaust fan for cooling (not shown) and thus discharges air around the preheating roller 56 to decrease the surface temperature of the preheating roller 56, to thereby cooling the preheating roller 56 so that the surface temperature thereof lowers to the determined preheating temperature. The preheating temperature in the preheating process can be thus controlled.

In the fixing steps the recording medium preheated passes through the pressure-contact area formed between the heating roller 51 and the pressurizing roller 52. The heating roller 51 is disposed so as to be capable of rotating when driven by a driving portion (not shown), and used to heat and thus melt the toner constituting the unfixed toner image carried on the recording medium so that the unfixed toner image is fixed to the recording medium. Inside the heating roller 51, a heating portion (not shown) is provided. The heating portion heats the heating roller 51 so that the surface of the heating roller 51 becomes a predetermined temperature (heating temperature). Usable examples of the heating portion include a heater and a halogen lamp. The heating portion is controlled by the fixing condition controlling section 64. In the vicinity of the surface of the heating roller 51, a temperature detecting sensor is provided for detecting a surface temperature of the heating roller 51.

A detection result obtained by the temperature detecting sensor is written in the memory portion 71 of the fixing condition controlling section 64. The pressurizing roller 52 is disposed in pressure-contact with the heating roller 51 and supported so as to be rotatable when driven by rotation of the heating roller 51. The pressuring roller 52 assists the fixing of the toner image to the recording medium by pressing the toner on the recording medium when the toner is molten by the heating roller 51 to be fixed to the recording medium. The pressure-contact area between the heating roller 51 and the pressurizing roller 52 is referred to as a fixing nip area. In the fixing section 4, the recording medium having a toner image transferred thereto in the transferring section 3 is held by and between the heating roller 51 and the pressurizing roller 52 and in passing through the fixing nip area, the toner image is pressed on the recording medium under heat so that the toner image is fixed on the recording medium on which an image is thus formed.

The fixing condition controlling section 64 controls the heating temperature of the heating roller 51. The heating temperature herein indicates a surface temperature of the heating roller 51. To a memory portion 71 of the fixing condition controlling section 64, a reference range of the heating temperature has been inputted in advance for each kind of recording mediums determined based on surface roughness thereof. The reference range of the heating temperature is 160° C. to 170° C. for standard paper, 150° C. to 160° C. for smooth paper, and 170° C. to 180° C. for rough paper. Moreover, a relation between the coverage rate and the heating temperature is inputted in form of data table to the memory portion 71 for each kind of recording mediums determined based on surface roughness thereof. Furthermore, to the memory portion 71, there is also inputted a detection result given by a temperature sensor provided in the vicinity of the surface of the heating roller 51 (that is, a detection result of surface temperature of the heating roller 51). In the fixing condition controlling section 64 which is started up upon the input of the recording medium determination result to the memory portion 71, the reference range of the heating temperature in the memory portion 71 is firstly referred to on the basis of the recording medium determination result. And then, by reference to the data of coverage rate and the data table indicating the relation between the coverage rate and the heating temperature in the memory portion 71, the heating temperature is determined.

Next, the detection result of the temperature sensor in the memory portion 71 is referred to and compared with the heating temperature determined as above. In the case where a comparison result thus obtained is that the determined heating temperature is higher than the detection result, a control signal is transmitted from a control portion 73 of the fixing condition controlling section 64 to a power source (not shown) which is incorporated in the heating roller 51 and applies voltage to the heating portion to develop heat, to thereby effect such voltage application that the surface temperature of the heating roller 51 rises up to the determined heating temperature.

In the case where a comparison result obtained as above is that the determined heating temperature is lower than the detection result, a control signal is transmitted from the control portion 73 of the fixing condition controlling section 64 to a driving source which drives an exhaust fan for cooling (not shown) and thus discharges air around the heating roller 51 to decrease the surface temperature of the heating roller 51, to thereby cooling the heating roller 51 so that the surface temperature thereof lowers to the determined heating temperature. The heating temperature in the fixing process can be thus controlled.

The discharging section 6 includes the conveying roller 37, a discharging roller 40, and a catch tray 41. The conveying roller 37 is disposed downstream of the fixing nip area along the paper conveyance direction, and conveys toward the discharging roller 40 the recording medium onto which the image has been fixed by the fixing section 4. The discharging roller 40 discharges the recording medium onto which the image has been fixed, to the catch tray 41 disposed on the vertically upper surface of the image forming apparatus 1. The catch tray 41 stores the recording medium onto which the image has been fixed.

The image forming apparatus 1 includes the control unit 7 represented by the attachment amount controlling section 61, the recording medium determining section 62, the preheating condition controlling section 63, and the fixing condition controlling section 64 as described above. For example, the control unit 7 is disposed in an upper part of an internal space of the image forming apparatus 1, and includes the memory portion 71, the computing portion 72, and the control portion 73. To the memory portion 71 of the control unit 7 are inputted, for example, various set values obtained by way of an operation panel (not shown) disposed on the upper surface of the image forming apparatus 1, results detected from sensor (not shown) etc. disposed in various portions inside the image forming apparatus 1, and image information obtained from an external equipment. Further, programs for operating various functional elements 74 are also written in the memory portion 71. For the memory portion 71, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 1. Examples of the external equipment include a computer, a digital camera, a television, a video recorder, a DVD recorder, an HDVD, a blu-ray disc recorder, a facsimile machine, and a mobile device. The computing portion 72 uses as references the various data (such as an image formation order, the detection result, and the image information) written in the memory portion 71 and the programs for various portions, thus making various determinations. The control portion 73 sends to a relevant device a control signal in accordance the determination result given by the computing portion 72, thus performing controls on operations. The control portion 73 and the computing portion 72 include a processing circuit which is achieved by a microcomputer, a microprocessor, etc. having CPU (central processing unit). The control unit 7 contains a main power source as well as the above-stated processing circuit. The power source supplies electricity to not only the control unit 7 but also respective devices provided inside the image forming apparatus 1. The attachment amount controlling section 61, the recording medium determining section 62, the preheating condition controlling section 63, and the fixing condition controlling section 64 constitute the functional elements 74 which are realized when the control unit 7 executes the programs for various functional elements 74.

In the image forming apparatus 1, the toner image formed in the toner image forming section 2 is transferred to the intermediate transfer belt 25 in the transferring section 3, and the toner image on the intermediate transfer belt 25 is then transferred to the recording medium and fixed thereto in the fixing section 4 where the recording medium is preheated by the preheating roller 56, whereby an image is formed on the recording medium that is then discharged to the catch tray 41 by way of the discharging section 6. In such an image forming operation, controls are performed on the attachment amount controlling section 61, the recording medium determining section 62, the preheating condition controlling section 63, and the fixing condition controlling section 64, whereby images having high quality at certain level are stably formed regardless of a type of recording mediums.

EXAMPLE

Hereinafter, the invention will be described in detail with reference to Examples and Comparative examples to which the invention is not particularly limited within its scope. In the following descriptions, "part" indicates "part by weight", and "%" indicates "% by weight", unless otherwise specified. A glass transition temperature and a softening temperature of binder resin, a melting temperature of a release agent, and a volume average particle size and an average degree of circularity of a toner in Examples and Comparative examples are measured as follows.

[Glass Transition Temperature (Tg) of Binder Resin]

Using a differential scanning calorimeter: DSC220 (trade name) manufactured by Seiko Electronics Inc., 1 g of a sample was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg).

[Softening Temperature (Tm) of Binder Resin]

Using a device for evaluating flow characteristics: Flow tester CFT-100C (trade name) manufactured by Shimadzu Corporation, 1 g of a sample was heated at a temperature of which increase rate was 6° C./min, under load of 10 kgf/cm$^2$ ($9.8\times10^5$ Pa) so as to be pushed out of a die (nozzle), and a temperature of the sample at the time when a half of the sample had flowed out of the die was determined as the softening temperature (Tm). The die used was 1 mm in nozzle aperture and 1 mm in length.

[Melting Temperature of Release Agents]

Using the differential scanning calorimeter: DSC220 (trade name) manufactured by Seiko Electronics Inc., 1 g of a sample was heated from a temperature of 20° C. up to 150° C. at a temperature of which increase rate was 10° C./min, and then an operation of rapidly cooling down the sample from 150° C. to 20° C. was repeated twice, thus obtaining a DSC curve. A temperature obtained at a top of an endothermic peak which corresponds to the melting shown on the DSC curve obtained at the second operation, was determined as the melting temperature of the release agent.

[Volume Average Particle Size of Toner]

To 50 ml of electrolyte solution: ISOTON II (trade name) manufactured by Beckman Coulter, Inc. were added 20 mg of a sample and 1 ml of sodium salt of alkyl ether sulfate, which were then subjected to a dispersion treatment at ultrasonic frequency of 20 kHz for three minutes by an ultrasonic dispersing machine: UH-50 (trade name) manufactured by SMT Co., Ltd., whereby a measurement sample was prepared. The measurement sample was analyzed by a particle size distribution-measuring device: Multisizer III (trade name) manufactured by Beckman Coulter, Inc., under the conditions that an aperture size was 100 μm and the number of particles for measurement was 50,000 counts. A volume particle size distribution of the sample particles was thus obtained from which the volume average particle size was then determined.

[Shape Factor SF2 of Toner]

On surfaces of toner particles, metal films were formed (that are Au films each having a thickness of 0.5 μm) by the sputtering deposition. From the metal film-coated toners thus obtained, 200 to 300 toners were randomly extracted and photographed at accelerating voltage of 5 kV and at 1,000-fold magnification by a scanning electron microscope: S-570 (trade name) manufactured by Hitachi Ltd. Thus-obtained data of electron micrograph was image-analyzed by use of an image analysis software: A-zo kun (trade name) manufactured by Asahi Kasei Engineering Corporation. Through this image analysis, the shape factor SF2 was determined.

[Degree of Circularity of Toner]

A degree of circularity (ai) of toner particles is defined by the above expression (1). The degree of circularity (ai) as defined by the expression (1) was determined by using a flow particle image analyzer: FPIA-3000 (trade name) manufactured by Sysmex Corporation. Moreover, an average degree of circularity (a) was defined by an arithmetic mean value which is obtained by the above expression (2) that a sum of respective degrees of circularity (ai) of "m" pieces of toners was divided by the number "m" of the toners.

[Preparation of Toner 1]

[Pulverized Material Preparing Step]

Toner raw materials were mixed for 10 minutes by a Henschel mixer: FM mixer (trade name) manufactured by Mitsui Mining Co., Ltd. The toner row materials contained, as indicated by combination ratios (part by weight), 80 parts by weight of polyester which serves as binder resin: Tafton TTR-5 (trade name) manufactured by Kao Corporation, having a glass transition temperature (Tg) of 60° C. and a softening temperature (Tm) of 100° C.; 12 parts by weight of master batch containing 40% by weight of C.I. pigment red 57:1 which serves as a colorant; 6 parts by weight of paraffin wax which serves as a release agent: HNP10 (trade name) manufactured by Nippon Seiro Co., Ltd., having a melting temperature of 75° C.; and 2 parts by weight of alkyl salicylate metal salt which serves as a charge control agent: Bontron E-84 (trade name) manufactured by Orient Chemical Industries, Ltd.

A thus-obtained admixture of raw materials was molten and kneaded by Kneadex MOS140-800 (trade name) manufactured by Mitsui Mining Co., Ltd., and cooled down to a room temperature. And then, a solidified product of molten and kneaded materials thus obtained was coarsely pulverized by a coarsely pulverizing device: Orient VM-27 manufactured by Seishin Enterprise Co., Ltd. Conditions for the melting and kneading operation were set as follows. A temperature on a supply side of a front roll was set at 75° C., a temperature on a discharge side of the front roll 50° C., temperatures on a supply side and a discharge side of a back roll 20° C., a rotation speed of the front roll 75 rpm (75 rotations per minute), a rotation speed of the back roll 60 rpm, and a speed of supplying the toner raw materials 10 kg/hour. A temperature of the toner raw material measured by an infrared noncontact thermometer during the melting and kneading operation was 120° C. or less at any kneading points. Subsequently, a coarsely pulverized matter obtained by coarsely pulverizing the solidified product of molten and kneaded materials was finely pulverized by a counter jet mill AFG manufactured by Hosokawa Micron Corporation, thus resulting in a pulverized material of resin composition.

[Spheronization Process Step]

Next, a hot-air-type spheronizing device: Meteo Rainbow (trade name) manufactured by Nippon Pneumatic MFG. Co., Ltd. was used for surface modification. Into the device, the above pulverized material of resin composition was put at a dose of 3.0 kg/hour to be then dispersed and atomized in hot air of 180° C., thereby having its surface thermally molten. The spheronization process was thus carried out.

[Classification Step]

The spheronized resin particles obtained as above were classified by wind power.

[External Addition Step]

An external addition process was carried out for externally adding external additives to the toner particles. With 100 parts by weight of the toner particles obtained by the classification process, 3.8 parts by weight in total of the external additives were mixed by the Henschel mixer: FM mixer (trade name) manufactured by Mitsui Mining Co., Ltd. The external additives consisted of 2.2 parts by weight of hydrophobic silica: R-974 (trade name) manufactured by Nippon Aerosil Co., Ltd. and 1.6 parts by weight of hydrophobic titanium: T-805 (trade name) manufactured by Nippon Aerosil Co., Ltd. A toner 1 was thus obtained which had a volume average particle size of 6.7 μm and an average degree of circularity of 0.955.

[Preparation of Toner 2]

A toner 2 was prepared in the same manner as the toner 1 except that operation conditions in the classification step were different. The toner 2 thus obtained had a volume average particle size of 7.1 μm and an average degree of circularity of 0.957.

[Preparation of Toner 3]

A toner 3 was prepared in the same manner as the toner 1 except that the spheronization process step was not carried out. The toner 3 thus obtained had a volume average particle size of 6.8 μm and an average degree of circularity of 0.947.

[Preparation of Toner 4]

A toner 4 was prepared in the same manner as the toner 1 except that carnauba wax was used as a release agent, which is specifically REFINED CARNAUBA WAX (trade name) manufactured by S. KATO & Co., having a melting temperature of 83° C. The toner 4 thus obtained had a volume average particle size of 6.5 μm and an average degree of circularity of 0.956.

[Preparation of Toner 5]

[Pulverized Material Preparing Step]

Toner raw materials were mixed for 10 minutes by a Henschel mixer: FM mixer (trade name) manufactured by Mitsui Mining Co., Ltd. The toner row materials contained, as indicated by combination ratios (part by weight), 80 parts by weight of polyester which serves as binder resin: Tafton TTR-5 (trade name) manufactured by Kao Corporation, having a glass transition temperature (Tg) of 60° C. and a softening temperature (Tm) of 100° C.; 12 parts by weight of master batch containing 40% by weight of C.I. pigment red 57:1 which serves as a colorant; 6 parts by weight of paraffin wax which serves as a release agent: HNP10 (trade name) manufactured by Nippon Seiro Co., Ltd., having a melting temperature of 75° C.; and 2 parts by weight of alkyl salicylate metal salt which serves as a charge control agent: Bontron E-84 (trade name) manufactured by Orient Chemical Industries, Ltd.

A thus-obtained admixture of raw materials was molten and kneaded by Kneadex MOS140-800 (trade name) manufactured by Mitsui Mining Co., Ltd., and cooled down to a room temperature. And then, a solidified matter of molten and kneaded materials thus obtained was coarsely pulverized by a coarsely pulverizing device: Orient VM-27 manufactured by Seishin Enterprise Co., Ltd., resulting in coarse particles of the molten and kneaded materials. Conditions for the melting and kneading operation were set as follows. A temperature on a supply side of a front roll was set at 75° C., a temperature on a discharge side of the front roll 50° C., temperatures on a supply side and a discharge side of a back roll 20° C., a rotation speed of the front roll 75 rpm (75 rotations per minute), a rotation speed of the back roll 60 rpm, and a speed of supplying the toner raw material 10 kg/hour. A temperature of the toner raw material measured by an infrared noncontact thermometer during the melting and kneading operation was 120° C. or less at any kneading points. The coarse particles of the molten and kneaded materials were divided into two groups which were furthermore coarsely pulverized by a cutting mill: VM-16 (trade name) manufactured by Ryoko Industry Ltd., and then finely pulverized by a counter jet mill, thus preparing a first pulverized material and a second pulverized material that were different in particle size.

[Spheronization Process Step]

Next, an impact-type spheronizing device: Faculty F-400 type (trade name) manufactured by Hosokawa Micron Corporation was used to apply the spheronization process to the second pulverized material having a larger volume average particle size than that of the first pulverized material.

[Classification Step]

A rotary classifier was used to classify the second pulverized material treated with the spheronization process to remove therefrom excessively pulverized toners having fine particles of which volume average particle size was undesirably small, whereby a second toner particle assemblage was obtained. Further, the rotary classifier was used to classify the first pulverized material having a smaller volume average particle size than that of the second pulverized material to remove therefrom excessively pulverized toners, whereby a first toner particle assemblage was obtained.

[Mixing Step]

The first toner particle assemblage and the second toner particle assemblage were mixed in the proportion of a hundred to fifty.

[External Addition Step]

With 100 parts by weight of the toner particle admixture containing the mixed first toner particle assemblage and second particle assemblage, 3.8 parts by weight in total of the external additives were mixed by the Henschel mixer: FM mixer (trade name) manufactured by Mitsui Mining Co., Ltd. The external additives consisted of 2.2 parts by weight of hydrophobic silica: R-974 (trade name) manufactured by Nippon Aerosil Co., Ltd. and 1.6 parts by weight of hydrophobic titanium: T-805 (trade name) manufactured by Nippon Aerosil Co., Ltd. A toner 1 was thus obtained. The toner particles admixture were thus subjected to the external addition process, resulting in a toner 5 which had a volume average particle size of 6.0 μm and a shape factor SF2 of 141.

[Preparation of Toner 6]

A toner 6 was prepared in the same manner as the toner 5 except that operation conditions in the classification step were different. The toner 6 thus obtained had a volume average particle size of 6.8 μm and a shape factor SF2 of 141.

[Preparation of Toner 7]

A toner 7 was prepared in the same manner as the toner 5 except that operation conditions in the classification step were different. The toner 7 thus obtained had a volume average particle size of 7.2 μm and a shape factor SF2 of 142.

[Preparation of Toner 8]

A toner 8 was prepared in the same manner as the toner 5 except that operation conditions in the classification step were different. The toner 8 thus obtained had a volume average particle size of 5.1 μm and a shape factor SF2 of 140.

[Preparation of Toner 9]

A toner 9 was prepared in the same manner as the toner 5 except that operation conditions in the classification step were different. The toner 9 thus obtained had a volume average particle size of 4.8 μm and a shape factor SF2 of 140.

[Preparation of Toner 10]

A toner 10 was prepared in the same manner as the toner 5 except that operation conditions in the classification step were different. The toner 10 thus obtained had a volume average particle size of 6.3 μm and a shape factor SF2 of 145.

[Preparation of Toner 11]

A toner 11 was prepared in the same manner as the toner 5 except that the mix proportion of the first toner particle assemblage to the second toner particle assemblage was not a hundred to fifty but a hundred to forty. The toner 11 thus obtained had a volume average particle size of 5.8 μm and a shape factor SF2 of 143.

[Preparation of Toner 12]

A toner 12 was prepared in the same manner as the toner 5 except that the first toner particle assemblage was also treated with the spheronization process as in the case of the second toner particle assemblage. The toner 12 thus obtained had a volume average particle size of 5.7 μm and a shape factor SF2 of 145.

[Preparation of Toner 13]

A toner 13 was prepared in the same manner as the toner 5 except that REFINED CARNAUBA WAX (trade name) manufactured by S. KATO & Co., having a melting temperature of 83° C. was used as a release agent, instead of the paraffin wax used for the preparation of the toner 1. The toner 13 thus obtained had a volume average particle size of 6.2 μm and a shape factor SF2 of 141.

[Preparation of Toner 14]

A toner 14 was prepared in the same manner as the toner 1 except that the temperature of the hot air in the spheronization process step was 240° C. after externally adding 2.2 parts by weight of hydrophobic silica: R-974 (trade name) manufactured by Nippon Aerosil Co., Ltd. to the toner particles in advance with the aim of suppressing particle-to-particle coagulation. The toner 14 thus obtained had a volume average particle size of 6.4 μm and a shape factor SF2 of 113.

Table 1 shows values of properties of the toners 1 to 14.

TABLE 1

| | Melting temperature of release agent (° C.) | Volume average particle size (μm) | Shape factor SF2 | Average degree of circularity |
|---|---|---|---|---|
| Toner 1 | 75 | 6.7 | 137 | 0.955 |
| Toner 2 | 75 | 7.1 | 136 | 0.957 |
| Toner 3 | 75 | 6.8 | 144 | 0.947 |
| Toner 4 | 83 | 6.5 | 135 | 0.956 |
| Toner 5 | 75 | 6.0 | 141 | 0.949 |
| Toner 6 | 75 | 6.8 | 141 | 0.949 |
| Toner 7 | 75 | 7.2 | 142 | 0.949 |
| Toner 8 | 75 | 5.1 | 140 | 0.950 |
| Toner 9 | 75 | 4.8 | 140 | 0.950 |
| Toner 10 | 75 | 6.3 | 145 | 0.947 |
| Toner 11 | 75 | 5.8 | 143 | 0.948 |
| Toner 12 | 75 | 5.7 | 138 | 0.950 |
| Toner 13 | 83 | 6.2 | 141 | 0.950 |
| Toner 14 | 75 | 6.4 | 113 | 0.986 |

[Evaluation Items]

[Evaluation on Image Scattering]

Images were outputted from a partially remodeled machine of the multifunctional printer: MX2700 (trade name) manufactured by Sharp Corporation. The images were 3 dot×3 dot in size and 600 dpi in resolution, and outputted at regular intervals. Unfixed toner images were thus obtained.

Fixing devices used were the fixing section 4 of the invention (referred to as "fixing device A") and a commonly-used two-roll fixing device (referred to as "fixing device B") which contained no preheating section. Of both the fixing devices, fixing temperatures were set at 170° C. and fixing speeds were set at 124 mm/sec in the pressure-contact area. Furthers a preheating temperature of the fixing device A was set at 100° C.

The images outputted were zoomed at 200-fold magnification by an optical microscope, and the number of scattered toners around the dots in the 3 dot×3 dot images were counted with eyes.

Excellent: toner scattering of less than 20 counts

Good: toner scattering of 20 or more counts and less than 30 counts

Not bad: toner scattering of 30 or more counts and less than 50 counts

Poor: toner scattering equal to 50 or more counts

Example 1

The toner 1 was outputted so that its toner attachment amount at a coverage rate of 100% would be in the order of 0.38 mg/cm$^2$, and an unfixed toner image thus obtained was then fixed in the fixing device A.

Example 2

An unfixed toner image was fixed in the same manner as Example 1 except that the toner 2 was used instead of the toner 1.

Example 3

An unfixed toner image was fixed in the same manner as Example 1 except that the toner 3 was used instead of the toner 1.

Example 4

An unfixed toner image was fixed in the same manner as Example 1 except that the toner 4 was used instead of the toner 1.

Example 5

An unfixed toner image was fixed in the same manner as Example 1 except that the toner 5 was used instead of the toner 1.

Example 6

An unfixed toner image was fixed in the same manner as Example 1 except that the toner 6 was used instead of the toner 1.

Example 7

An unfixed toner image was fixed in the same manner as Example 1 except that the toner 7 was used instead of the toner 1.

Example 8

An unfixed toner image was fixed in the same manner as Example 1 except that the toner 8 was used instead of the toner 1.

Example 9

An unfixed toner image was fixed in the same manner as Example 1 except that the toner 9 was used instead of the toner 1.

Example 10

An unfixed toner image was fixed in the same manner as Example 1 except that the toner 10 was used instead of the toner 1.

Example 11

An unfixed toner image was fixed in the same manner as Example 1 except that the toner 11 was used instead of the toner 1.

Example 12

An unfixed toner image was fixed in the same manner as Example 1 except that the toner 12 was used instead of the toner 1.

Example 13

An unfixed toner image was fixed in the same manner as Example 1 except that the toner 13 was used instead of the toner 1.

Example 14

An unfixed toner image was fixed in the same manner as Example 1 except that the toner 14 was used instead of the toner 1.

Comparative Example 1

An unfixed toner image was fixed in the same manner as Example 1 except that the fixing device B was used instead of the fixing device A.

Comparative Example 2

An unfixed toner image was fixed in the same manner as Example 1 except that the toner attachment amount at a coverage rate of 100% was in the order of 0.45 mg/cm$^2$ and the fixing device B was used instead of the fixing device A.

Comparative Example 3

An unfixed toner image was fixed in the same manner as Example 1 except that the toner attachment amount at a coverage rate of 100% was in the order of 0.45 mg/cm$^2$.

Comparative Example 4

An unfixed loner image was fixed in the same manner as Example 5 except that and the fixing device B was used instead of the fixing device A.

Comparative Example 5

An unfixed toner image was fixed in the same manner as Example 5 except that the toner attachment amount at a coverage rate of 100% was in the order of 0.45 mg/cm$^2$ and the fixing device B was used instead of the fixing device A.

Comparative Example 6

An unfixed toner image was fixed in the same manner as Example 5 except that the toner attachment amount at a coverage rate of 100% was in the order of 0.45 mg/cm$^2$.

Table 2 shows evaluation results of Examples 1-13 and Comparative examples 1-6.

TABLE 2

| | Toner | Fixing device | Toner attachment amount (mg/cm$^2$) | Image scattering: Counts of toner scattering | Image scattering: Evaluation result |
|---|---|---|---|---|---|
| Ex. 1 | 1 | A | 0.38 | 8 | Excellent |
| Ex. 2 | 2 | A | 0.38 | 25 | Good |
| Ex. 3 | 3 | A | 0.38 | 27 | Good |
| Ex. 4 | 4 | A | 0.38 | 24 | Good |
| Ex. 5 | 5 | A | 0.38 | 7 | Excellent |
| Ex. 6 | 6 | A | 0.38 | 9 | Excellent |
| Ex. 7 | 7 | A | 0.38 | 22 | Good |
| Ex. 8 | 8 | A | 0.38 | 10 | Excellent |
| Ex. 9 | 9 | A | 0.38 | 26 | Good |
| Ex. 10 | 10 | A | 0.38 | 24 | Good |
| Ex. 11 | 11 | A | 0.38 | 9 | Excellent |
| Ex. 12 | 12 | A | 0.38 | 28 | Good |
| Ex. 13 | 13 | A | 0.38 | 27 | Good |
| Ex. 14 | 14 | A | 0.38 | 28 | Good |
| Com. ex. 1 | 1 | B | 0.38 | 53 | Poor |
| Com. ex. 2 | 1 | B | 0.45 | 60 | Poor |
| Com. ex. 3 | 1 | A | 0.45 | 39 | Not bad |
| Com. ex. 4 | 5 | B | 0.38 | 57 | Poor |
| Com. ex. 5 | 5 | B | 0.45 | 61 | Poor |
| Com. ex. 6 | 5 | A | 0.45 | 44 | Not bad |

In Examples 1, 5, 6, 8, and 11, since the fixing device A was used, the preheating processes were preferably carried out and moreover, the toner attachment amounts on the recording medium at a coverage rate of 100% were 0.4 mg/cm$^2$ or less, with the result that very little toner scattering was caused and thus very favorable images were obtained.

In Comparative examples 1 and 4, a lot of toners scattered since no preheating process was carried out. In Comparative examples 2 and 5, no preheating process was carried out and furthermore, the toner attachment amounts on the recording medium at a coverage rate of 100% exceeded 0.4 mg/cm$^2$, with the result that a lot of toners scattered. In Comparative examples 3 and 6, the toner attachment amounts on the recording medium at a coverage rate of 100% exceeded 0.4 mg/cm$^2$ although the preheating processes were carried out, with the result that a lot of toners scattered.

In Example 1 and Comparative examples 1 to 3, the toner 1 was used which was 80° C. or less in the melting temperature of the release agent, 3 μm or more and 8 μm or less in the volume average particle size, and 0.950 or more and 0.985 or less in the average degree of circularity.

In Examples 5, 6, 8, and 11 and Comparative examples 4-6, the toners 5, 6, 8, and 11 were used which were 80° C. or less in the melting temperature of the release agent, 3 μm or more and 8 μm or less in the volume average particle size, and 140 or more and less than 145 in the shape factor SF2.

In Examples 2 and 7, the toners 2 and 7 were used which had relatively large volume average particle sizes, with the result that the toners scattered more than those in Examples 1, 5, 6, 8, and 11. However, in Examples 2 and 7, favorable images were obtained.

In Example 3, the toner 3 was used which had an average degree of circularity of less than 0.950, with the result that the toner scattered more than that in Example 1. However, in Example 3, favorable images were obtained.

In Example 14, the toner 14 was used which had an average degree of circularity exceeding 0.985, with the result that the toner scattered more than that in Example 1. However, in Example 14, favorable images were obtained.

In Example 9, the toner 9 was used which had a relatively small volume average particle size, with the result that the toner scattered more than those in Examples 1, 5, 6, 8, and 11. However, in Example 9, favorable images were obtained.

In Examples 4 and 13, the toners 4 and 13 were used which contained the release agent having a melting temperature of more than 80° C., with the result that the toners scattered more than those in Examples 1, 5, 6, 8, and 11. However, in Examples 4 and 13, favorable images were obtained.

In Example 10, the toner 10 was used which was relatively large in the shape factor SF2, with the result that the toner scattered more than those in Examples 5, 6, 8, and 11. However, in Example 10, favorable images were obtained.

In Example 12, the toner 12 was used which was relatively small in the shape factor SF2, with the result that the toner scattered more than those in Examples 5, 6, 8, and 11. However, in Example 12, favorable images were obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section including an image forming member, which forms a toner image on a surface of the image forming member;

an attachment amount controlling section which controls the toner image forming section so that an amount of toner attached to a recording medium at a coverage rate of 100% is 0.4 mg/cm$^2$ or less;

a transferring section which transfers the toner image to the recording medium to form an unfixed toner image;

a preheating section which preheats the unfixed toner image transferred to the recording medium before the unfixed toner image is fixed to the recording medium;

a preheating condition controlling section which controls a preheating condition in the preheating section; and a fixing section which fixes the unfixed toner image to the recording medium by letting the unfixed toner image preheated pass through a pressure-contact area formed between a heating roller and a pressurizing roller;

wherein the toner attachment amount is corrected in accordance with the coverage rate in the attachment amount controlling section, a control signal of the toner attachment amount is sent to the toner image forming section from the attachment amount controlling section.

2. The image forming apparatus of claim 1, wherein the toner has a volume average particle size of 3 μm or more and 8 μm or less with a shape factor SF2 of 140 or more and less than 145.

3. The image forming apparatus of claim 2, wherein the toner contains a plurality of toner particles, and a spheronization process is applied to at least a part of the toner particles.

4. The image forming apparatus of claim 2, wherein the toner has an average degree of circularity of 0.950 or more and 0.985 or less.

5. The image forming apparatus of claim 2, wherein the toner contains a release agent having a melting temperature of 80° C. or less.

6. The image forming apparatus of claim 1, wherein the preheating condition is controlled in accordance with at least one of usage environment-related information and recording medium-related information.

7. The image forming apparatus of claim 1, wherein the recording medium is carried on and conveyed by a preheating belt being on the pressurizing roller, and the recording medium is preheated via the preheating belt by a preheating roller.

8. The image forming apparatus of claim 7, wherein the preheating belt is preheated in contact with the preheating roller.

9. The image forming apparatus of claim 7, wherein the preheating belt is made of a thermal conductive material.

10. An image forming method for forming an image by using the image forming apparatus, the image forming method comprising:

a toner image forming step of forming a toner image on a surface of an image forming member;

an attachment amount controlling step of controlling in the toner image forming step so that an amount of toner attached to a recording medium at a coverage rate of 100% is 0.4 mg/cm$^2$ or less;

a transferring step of transferring the toner image to the recording medium to form an unfixed toner image;

a preheating step of preheating the unfixed toner image transferred to the recording medium before the unfixed toner image is fixed to the recording medium;

a preheating condition controlling step of controlling a preheating condition in the preheating step; and a fixing step of fixing the unfixed toner image to the recording medium by letting the unfixed toner image preheated pass through a pressure-contact area formed between a heating roller and a pressurizing roller, wherein the toner attachment amount is corrected in accordance with the coverage rate in the attachment amount controlling section, a control signal of the toner attachment amount is sent to the toner image forming section from the attachment amount controlling section.

* * * * *